US008153059B2

(12) United States Patent
Trieu et al.

(10) Patent No.: US 8,153,059 B2
(45) Date of Patent: Apr. 10, 2012

(54) CHIP-HOLDER FOR A MICRO-FLUIDIC CHIP

(75) Inventors: Hoc Khiem Trieu, Kamp-Lintfort (DE); Michael Bollerott, Essen (DE); Martin Kemmerling, Wetter (DE); Robert Hildebrand, Essen (DE); Jan Van Hest, Nijmegen (NL); Kaspar Koch, Nijmegen (NL); Pieter Nieuwland, Nijmegen (NL); Teris A. Van Beek, Opheusden (NL); Ernst J. R. Sudhölter, Schiedam (NL); Remko M. Boom, Wageningen (NL); Anja E. M. Janssen, Wageningen (NL); Floris Rutjes, Wychen (NL)

(73) Assignee: Fraunhofer-Gesellschaft zur Foerderung der Angewandten Forschung e.V., Munich (DE)

( * ) Notice: Subject to any disclaimer, the term of this patent is extended or adjusted under 35 U.S.C. 154(b) by 775 days.

(21) Appl. No.: 11/996,627

(22) PCT Filed: Jul. 25, 2005

(86) PCT No.: PCT/EP2005/008079

§ 371 (c)(1),
(2), (4) Date: Jun. 25, 2008

(87) PCT Pub. No.: WO2007/016931

PCT Pub. Date: Feb. 15, 2007

(65) Prior Publication Data

US 2008/0299013 A1 Dec. 4, 2008

(51) Int. Cl.
*B01L 9/00* (2006.01)

(52) U.S. Cl. ..... 422/50; 422/68.1; 422/500; 422/502; 422/62

(58) Field of Classification Search ..... 422/50, 422/55, 60, 61, 62, 63, 68.1, 82.05, 122, 422/500–508; 435/288, 291, 316, 803, 810
See application file for complete search history.

(56) References Cited

U.S. PATENT DOCUMENTS

| | | | | |
|---|---|---|---|---|
| 5,498,392 | A | 3/1996 | Wilding et al. | |
| 2003/0061687 | A1 * | 4/2003 | Hansen et al. | 23/295 R |
| 2003/0103207 | A1 | 6/2003 | Kopf-Sill et al. | |
| 2004/0141884 | A1 | 7/2004 | Unno et al. | |
| 2005/0118073 | A1 | 6/2005 | Facer et al. | |

FOREIGN PATENT DOCUMENTS

WO 2005/016532 A2 2/2005

OTHER PUBLICATIONS

Official communication issued in the International Application No. PCT/EP2005/008079: mailed on May 15, 2006.
Trieu et al., "Chip Holder, Fluidic System and Chip Holder System", U.S. Appl. No. 12/447,019, filed Aug. 18, 2009.

* cited by examiner

*Primary Examiner* — In Suk Bullock
*Assistant Examiner* — Sharon Pregler
(74) *Attorney, Agent, or Firm* — Keating & Bennett, LLP

(57) ABSTRACT

A chip-holder for holding a micro-fluidic chip has a fixer for detachably fixing the micro-fluidic chip in the chip-holder and at least one process control device configured to support control or monitoring of a chemical process in the micro-fluidic chip, wherein the chip-holder is configured such that the process control device and the micro-fluidic chip are directly and detachably coupled when the micro-fluidic chip is fixed in the chip-holder. Such a chip-holder brings along the advantage that the micro-fluidic chip can easily be removed and exchanged while the process control device can be reused. This reduces running costs of a chemical microreactor system drastically and allows for a very flexible usage of a chemical microreactor system.

27 Claims, 16 Drawing Sheets

CHIP-HOLDER FOR A MICRO-FLUIDIC CHIP

TECHNICAL FIELD

The present invention is related to a chip-holder for holding a micro-fluidic chip, in particular to a chip-holder for holding a glass or plastic micro-fluidic chip comprising control and regulation electronics.

BACKGROUND

Microreactors which can be implemented in the form of a glass or plastic micro-fluidic chip have many advantages when compared to traditional production means (or procedures).

1. By performing the actions in micrometer channels, very efficient mass and heat exchange processes will take place due to miniaturization. Reactions can be performed in a fraction of the traditional reaction times. Side reactions will be suppressed which will result in an increase in selectivity.
2. The high levels of control, as well as the application of small reaction volumes will result in a much safer use of inherently toxic or explosive compounds.
3. A change of reaction conditions can be applied very quickly, as a plurality of reaction channels and connections can be assembled on an integrated circuit. This results in a very flexible production process.
4. Besides the flexibility in reaction conditions, microreactors are also very well suited for performing combinatorial chemistry, via parallel synthetic procedures.
5. An increase in production volume from synthesis in a research environment to production scale can be carried out with microreactors by a scaling out procedure. Using an array of parallel operating chips, there is no need for extensive pilot plant studies. An increase in production volume is easily achieved by an increase in number of microreactors.
6. The high level of dimensional control on (sub)micron scale allows very well-defined production of micrometer sized morphologies, as applied in e.g. food textures.

Much research therefore has been performed to develop microreactor set-ups. In general, two approaches can be distinguished. One approach is to use micromachining for the construction of stainless steel microreactors. This has for example been performed by the German company CPC. Although elements such as mixing and heating can be built in, this method is more expensive and less flexible than the second approach, which uses etching and lithography techniques to prepare microreactors out of glass or silicon. A higher level of control over reaction parameters can be achieved with the second approach (or class) which therefore holds much promise for implementation in the industrial research environment.

One drawback with the present glass microsystems is that a set-up which combines synthesis, purification and characterization is not available. Important for a successful introduction of microreactor technology in the commercial market is that the set-up should be robust, user-friendly and cost-efficient. An integrated microreactor device which combines these parameters will therefore fulfil a concrete need.

Typical microreactors comprise a glass or plastic micro-fluidic chip, which is fixed in a chip-holder. FIG. 10*a* shows a three-dimensional drawing of a prior-art chip-holder. The three-dimensional drawing of FIG. 10*a* is designated in its entirety with 1700. FIG. 10*b* shows three-dimensional drawings of the individual components of the prior-art chip-holder shown in FIG. 10*a*. The three-dimensional drawings of FIG. 10*b* are designated in their entirety with 1750. The chip-holder which is shown in FIG. 10*a* and whose individual parts are shown in FIG. 10*b* is a product of Micronit company. It should be noted that same means are designated with the same reference numerals in FIGS. 10*a* and 10*b*. The prior-art chip-holder comprises a lower part 1710 and an upper part 1720. The lower part 1710 comprises a rectangular plastic body 1730. The plastic body 1730 of the lower part 1710 comprises a rectangular opening 1732. Furthermore, six threaded bolts 1734 are fixed to the plastic body 1730 of the lower part 1710. The upper part 1720 comprises a rectangular plastic body 1740. Plastic body 1740 exhibits a cuboidal protrusion 1742. The cuboidal protrusion 1742 of the upper part 1720 is designed to fix a micro-fluidic chip in the opening 1732 of the lower part 1710.

The upper part 1720 further comprises six holes 1744, five of which can be seen in FIG. 10*b*. The six holes 1744 in the plastic body 1740 of the upper part 1720 are placed in such a way that their positions fit the positions of the six threaded bolts 1734 in the plastic body 1730 of the lower part 1710. In other words, the upper part 1720 can be approximated to the lower part 1710 so that the six threaded bolts 1734 of the lower part pass through the six holes 1744 in the plastic body 1740 of the upper part 1720. The upper part 1720 can be fixed to the lower part 1710 by screwing knurled nuts 1748 to the threaded bolts 1734 of the lower part 1710. Accordingly, the knurled nuts 1748 allow the application of some pressure to the upper part 1720. Using the pressure, a micro-fluidic chip can be fixed between the upper part 1720 and the lower part 1710.

Besides, it should be noted that the upper part 1720 comprises a plurality of connection holes 1760. These connection holes 1760 match holes in the micro-fluidic chip which can be fixed between the lower part 1710 and the upper part 1720. The connection holes allow the connection of the micro-fluidic chip with external devices like a pumping device or an analysis unit.

SUMMARY

According to an embodiment, a chip-holder for holding a micro-fluidic chip may have: a fixer for detachably fixing the micro-fluidic chip in the chip-holder; at least one process control device adapted to support control or monitoring of a chemical process in the micro-fluidic chip; and a printed circuit board adapted to provide electrical connection to the process control device; wherein the process control device is a sensor or an actuator; wherein the chip-holder is adapted such that the process control device and the micro-fluidic chip are directly and detachably coupled when the micro-fluidic chip is fixed in the chip-holder; wherein the process control device is adapted such that the process control device is in a direct fluidic contact with a fluid channel of the micro-fluidic chip by an opening of the micro-fluidic chip, when the micro-fluidic chip is fixed in the chip-holder; wherein the process control device is a device chip attached to the printed circuit board; wherein the chip holder has a sealing ring adapted to form a sealing which is impermeable to a fluid in the microfluidic chip when a circumference of an opening of the microfluidic chip is in contact with the sealing ring, in order to form a fluid chamber bounded by the microfluidic chip, the sealing ring and at least one out of the printed circuit board and the process control device chip, such that fluid from the fluid channel can get in contact with the process control device chip.

The present invention creates a chip-holder for holding a micro-fluidic chip, the chip-holder comprising means for detachably fixing the micro-fluidic chip in the chip-holder and at least one process control device configured to support control or monitoring of a chemical process in that micro-fluidic chip. The chip-holder is configured such that the process control device and the micro-fluidic chip are directly and detachably coupled when the micro-fluidic chip is fixed in the chip-holder.

It is the key idea of the present invention to include a process control device in the chip-holder and to allow a direct but detachable coupling between the process control device contained in the chip-holder and the micro-fluidic chip. Accordingly, the process control device is part of the chip-holder, whereas the micro-fluidic chip can be removed from the chip-holder and be replaced by another micro-fluidic chip. However, the design of the chip holder in combination with the micro-fluidic chip can still guarantee a direct contact between the process control device and the micro-fluidic chip. This is due to the fact that the chip-holder is designed to fix the chip. The fixing of the micro-fluidic chip brings along the application of some force to the micro-fluidic chip. This force can not only fix the micro-fluidic chip in its position but also allows a very direct contact between the micro-fluidic chip and the process control device.

In this context, a process control device can be a sensor or an actuator. The direct coupling between the micro-fluidic chip and the process control device can be a thermal, an optical, a fluidic or an electrical coupling. For thermal coupling, direct coupling means that there is a thermal contact between the process control device and the micro-fluidic chip. A distance between the process control device (e.g. a temperature sensor, a heater, a cooler, or any thermally active device) should be smaller than a thickness of the process control device and the micro-fluidic chip. However, there may be a thin thermal coupling layer between the process control device and the micro-fluidic chip, for example comprising a thin metal layer, a heat-conducting paste or any other thermally-conductive material for usage in technical heat conduction.

A direct optical contact implies that a distance between an optical source or detector and the micro-fluidic chip is small enough to be overcome without any dedicated optical wave guide (e.g. optical fiber). In other words, an optical path not being confined by an optical waveguide structure is considered to form a direct optical coupling. However, this definition does not forbid that there is an optical beam forming device (e.g. a lens) included in the optical source or detector.

Furthermore it should be noted that direct fluidic contact is a contact between a fluid channel of the micro-fluidic chip and a sensor or actuator without any additional pipe. In other words, a sensor or actuator contained in the chip-holder is located so close to the micro-fluidic chip that the fluid channel which encloses the sensor is bounded by a structure of the micro-fluidic chip. So, there is no additional pipe between a fluidic connector of the sensor and the micro-fluidic chip. Of course, this does not exclude the possibility to have a fluidic pipe within the micro-fluidic chip, the sensor or actuator.

In other words, the chip-holder is configured such that the process control devices are in direct contact with the micro-fluidic chip, so that there are no extended transmission structures (having a length that is greater than two times the thickness of the micro-fluidic chip plus two times the thickness of the sensor) between the surface of the micro-fluidic chip and the sensor or actuator. The distance between the surface of the micro-fluidic chip and the process control device is typically less than three times the thickness of the micro-fluidic chip for which the chip-holder is designed.

On the other hand, it should be noted that the process control devices are still part of the chip-holder and can be separated from the micro-fluidic chip. In other words, there is no covalent bond between the micro-fluidic chip and the process control device.

The inventive chip-holder brings along a plurality of advantages. First of all, the process control device, typically a sensor or actuator, is in direct contact with the micro-fluidic chip. Accordingly, sensing or actuation can occur at a location which is very close to a location at which a chemical reaction occurs in the micro-fluidic chip. As a result, the process conditions can be adjusted precisely to the desired conditions. Also, a control loop can be established, as the process conditions can be sensed by a sensor located very close to the micro-fluidic chip. This is in contrast to solutions where an analysis is only possible when products of a chemical reaction leave the micro-fluidic chip over a fluidic outlet. The direct contact between analysis devices and the micro-fluidic chip results in a drastic reduction of the delay when compared to solutions where analysis only occurs when the reaction products leave the micro-fluidic chip over an outlet. According to the present invention, chemical sensors located within the chip-holder may even be in fluidic contact with the fluid channels contained in the micro-fluidic chip. In this case, a very rapid analysis of the process products can be performed and the results of this analysis can be used for process control. Again, the direct proximity of process control devices to the micro-fluidic chip reduces delay times in a control loop and therefore may improve the stability of the process.

On the other hand, the present invention also brings along the advantage that the process control devices are a part of the chip-holder and may therefore be separated from the micro-fluidic chip. Accordingly, the process control devices can be reused even if the micro-fluidic chip is exchanged. This is very advantageous as the micro-fluidic chip is prone to pollution or defect (e.g. blocking of a fluid channel) and therefore may need to be exchanged regularly. The inventive concept of a chip-holder which contains a process control device that is detachably coupled with the micro-fluidic chip allows the usage of a very simple micro-fluidic chip without any process control devices fixed to the micro-fluidic chip. Accordingly, the micro-fluidic chip can be made very cheap. On the other hand, the chip-holder which carries the expensive process control means (sensors or actuators) can be reused. It may even be combined with different micro-fluidic chips which are adapted for different chemical processes (e.g. by adapting the dimensions of the fluid channels).

Accordingly, the inventive chip-holder allows the implementation of very cheap micro-fluidic chips while maintaining a very high degree of process control and the possibility to have a variety of sensors or actuators directly coupled with the fluid channels of the micro-fluidic chip.

In an embodiment, the process control device is a sensor and the chip-holder comprises an electronic circuit for processing data from the sensor and for providing information based on the data from the sensor. In other words, a data processing means is directly enclosed in the chip-holder. This brings along the advantage that data does not need to be transmitted from the sensor to a processing device over a long distance, which may result in strong signal distortion.

In another embodiment, the process control device is an actuator, and the chip-holder further comprises an electronic circuit for providing an electronic signal to the actuator based on information received from a control interface. Such a configuration results in a chip-holder having the necessary electronics to provide control signals to the actuator. Accordingly, only digital control signals need to be transmitted to the chip-holder. Again, interference programs can be reduced. This is particularly due to the fact that actuators necessitate relatively strong signals. Such signals could easily distort other equipment if they were transmitted over a long distance.

In a further embodiment, the process control device is a sensor, and the chip-holder further comprises an actuator configured to impact process conditions of a chemical process in the micro-fluidic chip. In addition, the chip-holder comprises an electronic circuit configured to receive a sensor signal from the sensor and to provide an actuator signal to the actuator, wherein the electronic circuit is configured to implement a feedback control circuit for adjusting the actuator control signal in response to the sensor signal. In other words, the chip-holder itself implements a complete control system. Sensing, actuation and the generation of actuator control signals occur in very close proximity to the micro-fluidic chip. Accordingly, a control loop with a very low delay time can be closed as both the sensor and the actuator are directly coupled to the micro-fluidic chip when the micro-fluidic chip is fixed in the chip-holder. Again, there is a clear separation between the micro-fluidic chip and the control means comprising sensor, actuator and control circuit. The micro-fluidic chip can be exchanged without affecting any of the control means. Also, the chip-holder can stabilize the running chemical process without any external control signals. Accordingly, there is no need for a permanent connection to an external control circuit or computer. This is particularly important, as in a production environment there may be a very large number of individual chip-holders. Accordingly, the cabling effort would be very high if the chip-holders would need a permanent connection with an external control circuitry or a computer. Also, the load for an external control circuitry would be very high, if many processes would need to be controlled by a centralized control means permanently. In contrast, a chip-holder which can perform process control autonomously can eliminate the need for a centralized process controller and an extensive cabling. Also, signal distortion can be reduced drastically in a production environment with a large number of chip-holders being located as close as possible.

In another embodiment the electronic circuit comprises a microprocessor and an interface circuitry for establishing a connection with an external computer device. However, it should be noted that this connection is not necessitated for normal process control. In other words, not all the sensor data need to be transported over the connection. In contrast, the connection can be used to monitor only some relevant parameters or even to transport exclusively alarm signals indicating that a chemical process in the micro-fluidic chip is in an abnormal condition. Furthermore, the connection between the electronic circuit and the external computer device can be used in order to update the control routines in the electronic circuit should this be necessary (e.g. due to a change of the type of chemical reaction). Indeed it should be noticed that the computer connection does not need to be permanently established. In some applications it may be sufficient to use this computer connection for reprogramming the electronic circuit only whenever the process is changed. This may occur very rarely and maybe combined with an exchange of the micro-fluidic chip.

In a further embodiment the chip-holder comprises a printed circuit board configured to provide an electrical connection to the process control device, wherein the process control device is attached (mounted) to the printed circuit board. The usage of a printed circuit board as a carrier for the process control device has the advantage that even an unpackaged process control device may be attached to a printed circuit board using one of the common attachment technologies. Accordingly, unpackaged sensors or actuators that merely comprise a chip made of some substrate (e.g. semiconductor or some isolator like glass, ceramic or even plastic) can be attached to the printed circuit board. A printed circuit board allows the advantageous formation of electrical contacts, and the printed circuit board may comprise electrical wiring and contact pads which are be brought (routed) into direct proximity of any sensor elements. Accordingly, a sensor can be made very small as the need for a large package comprising electrical connections is eliminated. Also it should be noted that printed circuit board technology is relatively cheap, and that printed circuit boards exhibit very good mechanical characteristics. Besides, the placement of sensor on top of a printed circuit board can be performed with a very high accuracy using standard circuit board loading equipment. In addition, connections can be routed over the circuit board with high precision and good decoupling characteristics. Assembly of the circuit board can be performed completely automated.

Furthermore it should be noted that a circuit board is typically planar, so that it is very well adapted to a micro-fluidic chip. Accordingly, alignment precision of the process control devices on the printed circuit board is very high. This is important, as it is a target of the present invention to provide a direct contact between the process control device and the micro-fluidic chip. Even higher requirements to alignment position apply if a plurality of process control devices is necessitated. In particular, planarity of the surfaces is critical for establishing direct contact between a process control device and the micro-fluidic chip. Again, the intrinsic planarity of a printed circuit board and the respective high-precision board loading technology are very well-suited for fulfilling these requirements.

In another embodiment, the printed circuit board is configured to be parallel to the micro-fluidic chip when the micro-fluidic chip is fixed in the chip-holder. In this case it is assumed that a surface of the micro-fluidic chip, which is adjacent to the printed circuit board when the micro-fluidic chip is fixed in the chip-holder, is planar with the exception of one or more openings which may exist in the surface adjacent to the printed circuit board. Accordingly it is assumed that the surface of the micro-fluidic chip which is adjacent to the printed circuit board is parallel to a surface of the printed circuit board. This is an advantageous configuration as printed circuit board loading technology is very well-suited for placing sensor or actuator devices on the printed circuit board, so that the surfaces of the sensor or actuator devices are parallel to the printed circuit board. As a consequence, the surfaces of the sensor or actuator devices are parallel to the surface of the micro-fluidic chip adjacent to the printed circuit board. This allows the establishment of a very good contact between the sensor or actuator devices and the micro-fluidic chip. Existing height differences may easily be balanced by attaching some contact pads to the sensor or actuator devices, wherein the contact pads may have a homogenous thickness. This fact facilitates the fabrication significantly when compared to a gap of varying thickness between a sensor or actuator and the micro-fluidic chip.

It is advantageous that the process control device is a chip attached to the printed circuit board. An economically particularly advantageous solution can be using an unpackaged chip as a process control device. Accordingly, high costs for packaging can be saved. On the other hand, an unpackaged process control device chip can be attached to a printed circuit board without any major problems. Further advantages of using an unpackaged chip have already been described above.

An unpackaged process control device chip has a top surface and a bottom surface, wherein an active area for controlling or monitoring the chemical process is located on the top surface and wherein the bottom surface, which is opposite to the top surface, is attached to the printed circuit board. An electric connection between the top surface and the bottom surface is implemented using through-wafer interconnects. Accordingly, the active area for controlling or monitoring the chemical process is in close proximity to the micro-fluidic chip. As a consequence, the coupling between the active area and the micro-fluidic chip is very close. It is even possible that the active area of the chip touches the surface of the micro-fluidic chip. However, it should be noted that it is difficult to make any electrical contacts in the top surface of the process control device chip if the top surface of the process control device chip is very close to the micro-fluidic chip. Therefore it is advantageous to introduce through-wafer interconnects to the process control device chip. Accordingly, electrical contacts of the process control device chip are routed to the bottom surface of the process control device chip. The bottom surface of the process control device chip can be attached to the printed circuit board. It is advantageous that the process control device chip is attached to contact pads of the printed circuit board using bumps or conductive adhesive. These connection methods have shown to be advantageous when making a connection from a back side (bottom surface) of a process control device chip, where electrical signals are routed from the top surface of the process control device chip to the bottom surface of the process control device chip using through-wafer interconnects.

In another embodiment the process control device chip has a top surface and a bottom surface, wherein an active area for controlling or monitoring the chemical process in the micro-fluidic chip is located on the bottom surface and wherein the bottom surface is attached to the printed circuit board. In other words, the active area of the chip is adjacent to the printed circuit board. Although the coupling between the active area and the micro-fluidic chip is not so close as in the case in which the active surface is on the top surface of the process control device chip, there is still a direct coupling between the sensor or actuator and the micro-fluidic chip, as the top surface of the process control device chip may still be adjacent to the micro-fluidic chip. However, the active area is protected in this case as is it next to the PCB. Accordingly, the active area may not be damaged easily when the micro-fluidic chip is changed. Besides, it is not necessary to have a through-wafer interconnect, because the active area is on the same surface of the process control device chip as the connections to the printed circuit board. This can substantially reduce the fabrication costs for the process control device chip.

Again, the process control device chip is advantageously attached to contact pads of the printed circuit board using bumps or conducting adhesive.

It is advantageous that the process control device chip is configured such that a fluid can pass through from the top surface of the process control device chip to the bottom surface of the process control device chip. In this configuration, the top surface of the process control device chip may be directly in contact with a fluid channel of the micro-fluidic chip. Furthermore, the fluid can pass through an opening in the process control device chip from the top surface to the bottom surface and therefore reach the active area very fast. Here it should be noted that the process control device chip is typically very thin (typically less than 1 mm), so that there is still no remarkable thermal or optical resistance between the active area of the process control device chip and the micro-fluidic chip.

In another embodiment, the chip-holder further comprises an underfiller layer configured to fill the volume between the (process control) device chip and the printed circuit board. The underfiller layer gives mechanical stability to the device chip, as the underfiller layer transfers a significant part of the force which may be applied to the device chip. This is particularly important if the device chip is in direct mechanical contact with the micro-fluidic chamber. Accordingly, the force which is applied to the device chip is not only transferred by the bumps that connect the device chip to the printed circuit board. In a consequence, the risk of damage to the device chip is reduced. Furthermore, the underfiller layer surrounds the bumps which connect the device chip to the printed circuit board. Accordingly, fluid which may be guided to the bottom surface of the device chip cannot get in contact with the bumps. In this way, the underfiller layer separates the bumps from the fluid. This is very advantageous, as the fluid may be conductive so that the signals provided by a sensor chip may be falsified. Also, the fluid should be isolated from the electrical signals, as the electrical signals may cause chemical reactions or alter the electrochemical potential of the fluid. Furthermore, many fluids may be aggressive and tend to destroy the electrical contacts. This can also be avoided due to the underfiller layer.

It should be noted that the underfiller may comprise a recess configured so that the fluid can contact the active area, if this is desired. However, the underfiller layer may have no recess if the process control device chip does not necessitate fluid contact at its bottom surface (which is e.g. true for a temperature sensor, a heater or a cooler).

In other words, it is advantageous if the device chip is attached to the printed circuit board using a flip-chip technology. The flip-chip technology can easily be applied to an unpackaged chip.

In an embodiment, the process control device is configured such that it is in direct fluid contact with a fluid channel of the micro-fluidic chip when the micro-fluidic chip is fixed in the chip-holder. In other words, there is no additional pipe between the process control device and the fluid channel of the micro-fluidic chip. The fluid channel may be a microchannel in a typical micro-fluidic chip. In other words, the micro-fluidic chip may have an opening which is connected to one of the fluid channels contained in the micro-fluidic chip. The process control device, a sensor or actuator, may be brought into very close contact with the fluid channel. The process control device may even reach into the opening of the micro-fluidic chip when the micro-fluidic chip is fixed in the chip-holder. The direct fluidic contact is advantageous, as properties of the fluid in the fluid channel can be determined with very little delay. Also, a very direct impact can be effected on the liquid in the micro-fluidic channel. For example, the process control device can be an actuator like a pump or a heater. In this case, a very fast effect can be achieved, as the actuator is only a few millimeters away from the micro-fluidic chip or even reaches into the micro-fluidic chip. Further advantages of such a direct contact have already been explained in detail before.

A further improvement of the above-mentioned concept can be achieved if the process control device is configured such that it is in a direct fluidic contact with a reactor channel of the micro-fluidic chip when the micro-fluidic chip is fixed in the chip-holder. In this configuration the sensor or actuator is right at the position where a chemical reaction in the micro-fluidic chip takes place. As a consequence, a maximum level of control can be achieved. Process conditions in the reactor channel can be sensed and modified according to the needs of the reaction. It should be noted that the reactor channel in a micro-fluidic chip is very small. Accordingly, the reaction conditions are very uniform and do not vary strongly over the reactor channel. So, having access to the microreactor channel, the process conditions can be controlled with an extreme accuracy that cannot be reached by any other known process control means. Furthermore, it should be noted that the micro-fluidic chip can be exchanged whenever this is necessary without changing the process control device. Accordingly, costs can be kept small. Also, the geometry of the reactor channel may be changed by replacing the original micro-fluidic chip by another micro-fluidic chip. In conventional techniques, there are no sensors within a reaction chamber. Additionally, it is not known to have reusable sensors which are part of a chip-holder and which remain connected to the chip-holder when the micro-fluidic chip (microreactor) is changed.

In another embodiment of the inventive chip-holder, the process control device is a device chip attached to a printed circuit board (PCB). The device chip comprises a bottom surface adjacent to the printed circuit board, a top surface opposite to the bottom surface and at least one side surface adjacent to the bottom surface or the top surface. For example, if the device chip is cuboidal and the thickness of the chip is smaller than the other dimensions, then the two big surfaces form the top surface and the bottom surface. The four smaller surfaces form the side surfaces. As another example, if the device chip is round (more precisely: cylindrical) and the thickness (height of the cylinder) is smaller than the other dimensions, then the two circular surfaces form the top surface and the bottom surface. The shell of the cylindrical device chip forms the side surface. Under these assumptions, the device chip is encircled by a sealing ring contacting the printed circuit board and the at least one side surface of the device chip. In other words, a gap between the edges of the device chip adjacent to the printed circuit board and the printed circuit board is sealed by the sealing ring. The sealing ring therefore contacts any side surfaces of the device chip and the printed circuit board. Accordingly, fluid can not be exchanged through the gap between the bottom surface of the device chip and the printed circuit board.

In another embodiment the sealing ring is configured to form a sealing which is impermeable to a fluid in the micro-fluidic chip when a circumference of an opening of the micro-fluidic chip is in contact with the sealing ring. In other words, the sealing ring forms a fluid chamber in combination with the printed circuit board and the micro-fluidic chip. The process control device, typically a sensor or actuator chip, is enclosed in this fluid chamber. Also, in an embodiment the sealing ring is in direct contact with at least one side surface of the process control device chip so that fluid can not enter the gap between the process control device chip and the printed circuit board. The described geometry has the advantage that a fluid chamber can be formed which is bounded by the micro-fluidic chip, the sealing ring and at least one out of the printed circuit board and the process control device chip. Accordingly, a fluid from a fluid channel in the micro-fluidic chip can get in contact with the process control device chip. The device chip can sense a characteristic of the fluid or perform some action (e.g. heating, pumping) to the fluid. The sealing ring prevents any leakage of the fluid out of the predetermined fluid chamber.

It is advantageous that the sealing ring has a circular or elliptic cross-section. As explained above, the sealing ring should be in contact with both the printed circuit board the side surfaces of the process control device chip. For additional sealing, the sealing ring should also be in contact with the micro-fluidic chip, whose surface is typically parallel to the surface of the printed circuit board. It has been shown that a cylindrical or elliptical fluid ring offers the best sealing to the three surfaces (micro-fluidic chip, printed circuit board, side surface of the device chip). The cylindrical or elliptical shape supports an even distribution of the applied pressure. Also a small lateral shift of the micro-fluidic chip (i.e. a shift in parallel to the surface of the printed circuit board) is not critical if the sealing ring has a circular or elliptical shape due to the big contact surface. Also, by the application of some pressure between the printed circuit board and the micro-fluidic chip the sealing characteristics of the sealing ring will be improved as pressure will result in an enlargement of the sealing surface (contact surface) due to the circular (or elliptical) cross-section.

It is further advantageous that the sealing ring is formed from elastic polymer. It has been found out that elastic polymers can very well withstand the temperatures which occur in a micro-fluidic chip. Furthermore, the chemicals used in relevant chemical processes do not destroy a sealing ring consisting of an elastic polymer. Besides, elasticity is very important in order to balance any mechanical tolerances. It has further been found out that silicone or viton are very well-suited materials for a sealing ring. Apart from being mechanically elastic and resistant to the chemicals which are typically used, silicone can be processed in a very advantageous way. A sealing ring with an approximately cylindrical or elliptical cross-section can easily be produced using a dispenser. Later on, the silicone will solidify and reaches its final mechanical characteristics.

In another embodiment, the inventive chip-holder further comprises a first fluidic connection to an inlet of the micro-fluidic chip and a second fluidic connection to an outlet of the micro-fluidic chip. Such connections are configured for attaching an external device (like a pump, a vessel or an external chemical analysis device) to the micro-fluidic chip. For allowing a fluidic connection, there may be some connection holes in the chip-holder. Glass pipes can be fixed in these connection holes, so that they contact the micro-fluidic chip when the micro-fluidic chip is fixed in the chip-holder. Furthermore, it should be noted that sealings may be used in order to avoid any leakage at the inlet and the outlet of the micro-fluidic chip. The described glass pipes may be fixed permanently to the chip-holder or may be detachable. It should further be noted that there may be more than one inlet and more than one outlet.

In another embodiment, the inventive chip-holder further comprises a barcode reader configured to read a barcode tag of the micro-fluidic chip. It was found out that it is advantageous to label micro-fluidic chips with barcodes. These barcodes may identify a type of the micro-fluidic chip. Accordingly, any electronic circuit in the chip-holder can determine automatically which type of micro-fluidic chip is present in the chip-holder. Thus it can be checked whether the correct type of micro-fluidic chip is present and, if there are several types that are appropriate, which type exactly is present. Consequently the control circuitry contained in the chip-holder can adjust the reaction conditions in dependence on the type of micro-fluidic chip. Furthermore, the barcode may contain a unique identifier of a micro-fluidic chip, and the barcode can be used in order to update a database which may contain information on which chemical processes have been performed in a particular micro-fluidic chip. Also, it can be monitored using the database whether allowable process conditions have been obeyed. For example, it can be recorded in the database whether a maximum allowable temperature has been exceeded for a particular micro-fluidic chip. If this is so, it can be indicated to a user that the micro-fluidic chip has to be exchanged. Also, it can be recorded with which chemicals a particular micro-fluidic chip had contact. If the micro-fluidic chip had contact with inappropriate chemicals, it may be indicated by the database that the micro-fluidic chip may no longer be used for a particular type of chemical process.

In a further advantageous embodiment, the chip-holder comprises an ID tag reader configured to read an ID tag of the micro-fluidic chip. An ID tag in the micro-fluidic chip, which may also be an RF-ID tag, may contain relevant data about the chip-holder. The ID tag may contain a serial number but may also advantageously contain information about the characteristics of the micro-fluidic chip and the processes which have already been run in the micro-fluidic chip. The chip-holder may further be configured to update the information of the ID tag of the micro-fluidic chip. For example, the chip-holder may write information about the current chemical process into the ID tag. Also, information about abnormal conditions may be recorded. Accordingly, it is no longer necessary to maintain a centralized database with information about the micro-fluidic chips. In contrast, every micro-fluidic chip may carry its own life cycle information and exchange it with the chip-holder whenever necessary.

In another embodiment, the inventive chip-holder further comprises an opening configured to allow for an optical inspection of fluid channels of the micro-fluidic chip when the micro-fluidic chip is fixed in the chip-holder. Such an optical inspection may be necessary in order to monitor whether appropriate conditions for a chemical reaction are maintained. For example, it can be checked whether a laminar flow is maintained in the micro-fluidic chip. For this purpose, the opening in the chip-holder must be configured such that an optical path is available to the flow channels of the micro-fluidic chip. Furthermore, it may be necessary to have a mirror surface in the chip-holder. This mirror surface may advantageously be configured such that the micro-fluidic chip is located between the opening and the mirror surface when the micro-fluidic chip is fixed in the chip-holder. Under this condition, the mirror surface allows an optical inspection of the micro-fluidic chip using a microscope.

In an embodiment, the chip-holder is configured such that the micro-fluidic chip is fixed in the chip-holder by a mechanical pressure. For example, the chip-holder may comprise an upper part and a lower part which can be pressed together using screws. In this case the micro-fluidic chip may be fixed between the upper part and the lower part. The process control device and additional control circuitry may be embedded in either the upper part or the lower part of the chip-holder so that the process control device is in direct contact with the micro-fluidic chip when the micro-fluidic chip is fixed between the upper part and the lower part of the chip-holder. The upper part and the lower part may, for example, be fixed together using threaded bolts and knurled nuts. In this case, the two parts of the chip-holder may be put together manually. However, automated solutions are also possible.

It should further be noted that the process control device can be chosen from a wide variety of sensors or actuators. For example, a temperature sensor, a pressure sensor, a flow sensor, a pH sensor or a conductivity sensor can be used. Also, a reaction species measurement device or a reaction yield measurement device could be used. Furthermore, usage of any other chemical analysis device in combination with the inventive chip-holder can bring along a big advantage. A very fast process control with little delay and high accuracy can be achieved, as sensing can be done very close to the location of the chemical reaction.

Also, actuators which can have an impact on the process conditions may be used as the process control device. For example, a heater or a cooler can be used to stabilize the reaction temperature. Also, a Peltier-element may be used as a universal solution. Furthermore, a flow activation device or a pressurizing device could be used in order to have an effect on the flow conditions in the micro-fluidic chip. For example, pressure and flow rate may affect the quality of flow substantially. For example, a laminar flow can only be achieved under certain conditions. Any device which is able to control these conditions may help to achieve a laminar flow, which will result in a very well-controlled chemical reaction. Also, pumps could be introduced directly into the micro-fluidic chip (through an opening in the micro-fluidic chip) without the requirement to implement the pump within the micro-fluidic chip. Even a complex micropump could be a part of the chip-holder.

Besides, electrical contact can be made with the liquid in the micro-fluidic chip. For example, a potential bias device may be used to set up electrochemical reaction conditions. The same can be achieved by a charge delivery device.

BRIEF DESCRIPTION OF THE DRAWINGS

Embodiments of the present invention will be detailed subsequently referring to the appended drawings, in which.

DETAILED DESCRIPTION

Figure 1:
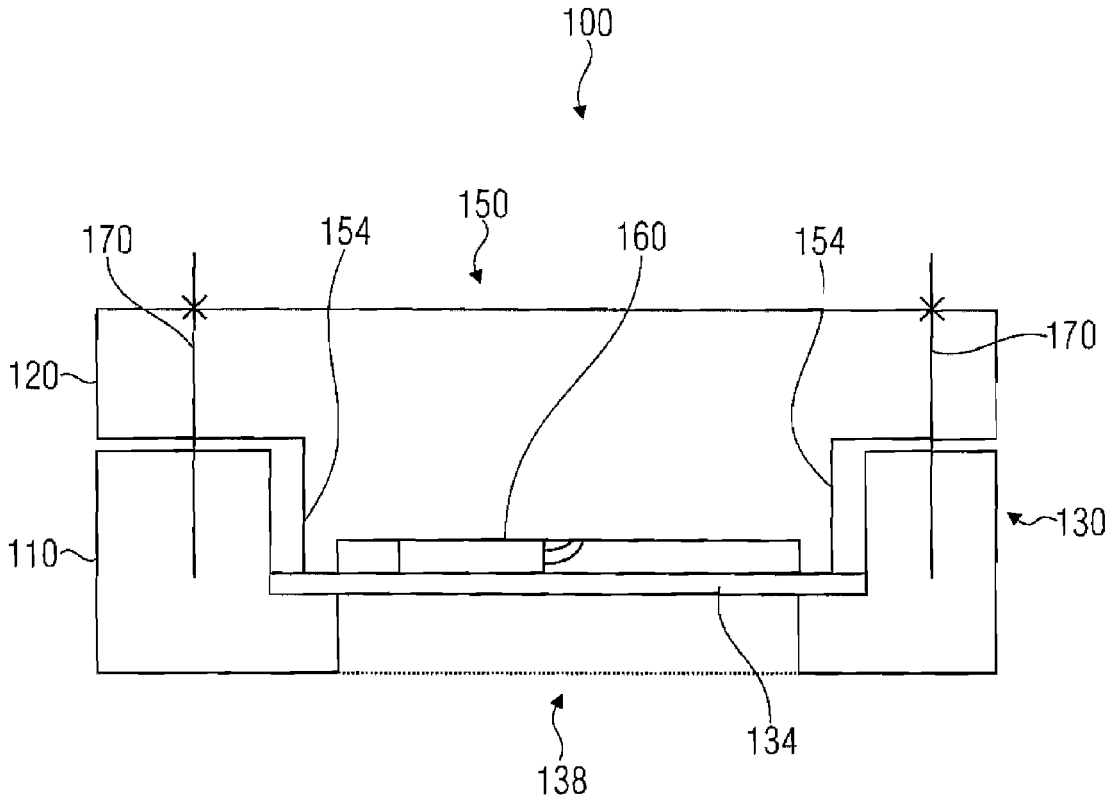
FIG. 1 shows a cross-section of an inventive chip-holder according to a first embodiment of the present invention.

FIG. 1 shows a cross-section of an inventive chip-holder according to a first embodiment of the present invention. The chip-holder is designated in its entirety with 100. The chip-holder 100 comprises a lower part 110 and an upper part 120. The lower part 110 comprises a recess 130 configured to carry a micro-fluidic chip 134. The lower part 110 further comprises an opening 138 which allows an optical inspection of the micro-fluidic chip.

The upper part 120 exhibits a large protrusion 150, which is adapted to fit the recess 130 of the lower part 110, wherein a gap between the large protrusion 150 and the recess 130 may remain. The upper part 120 further comprises small protrusions 154 located on the large protrusion 150 and configured to apply some pressure to the micro-fluidic chip 134 in order to fix the micro-fluidic chip 134 between the lower part 110 and the upper part 120. The upper part 120 further comprises a process control device 160, which is attached to the large protrusion 150 of the upper part 120 in such a way that it is in direct contact with the micro-fluidic chip 134, when the micro-fluidic chip 134 is fixed between the lower part 110 and the upper part 120 of the chip-holder 100. It should further be noted that the upper part 120 and the lower part 110 of the chip-holder 100 are fixed together using fixing means 170. The fixing means 170 can be screws, threaded bolts in combination with conventional nuts or knurled nuts, or any other mechanical appliance which can be used to apply a mechanical force between the lower part 110 and the upper part 120 of the chip-holder 100.

It should further be noted that the process control device 160 may be a sensor or an actuator. The process control device 160 may have a mechanical contact, an optical contact or a thermal contact with the micro-fluidic chip 134. The process control device 160 may even have a direct fluidic contact with a fluid channel of the micro-fluidic chip 134.

Based on the above structural description, the function of the inventive chip-holder 100 will subsequently be discussed. The inventive chip-holder 100 allows fixing a micro-fluidic chip 134 between a lower part 110 and an upper part 120 of the chip-holder 100. However, it is very important that the upper part 120 of the chip-holder 100 comprises a process control device 160 which can be brought in direct but detachable contact with the micro-fluidic chip 134. Accordingly, the process control device 160 can be separated from the micro-fluidic chip 134 when the micro-fluidic chip 134 is removed from the chip-holder 100 after usage. It should be noted that the micro-fluidic chip 134 can be removed from the chip-holder 100 after unfastening the fixing means 170. After unfastening, the upper part 120 and the lower part 110 of the chip-holder 100 can be separated. The process control means 160 is fixed to the upper part 120, while the micro-fluidic chip 134 can be removed from the chip-holder.

This is advantageous as the most sensitive part of the microreactor set-up is the glass or plastic microreactor part, also designated as micro-fluidic chip. Because reactions occur in microchannels of the glass or plastic microreactor part or micro-fluidic chip 134, blockage can be a problem. Accordingly, it is necessary to deal with the problem of blockage in an efficient way. One possible solution is to make the glass or plastic part a disposable part of the set-up. In other words, the glass or plastic microreactor or the micro-fluidic chip 134 are configured to be disposable parts. Therefore it is advantageous to have a chip-holder which allows an exchange of the glass or plastic microreactor or the micro-fluidic chip 134. It should also be noted that glass or plastic microchips (like the micro-fluidic chip 134) can be produced with relatively low costs. In contrast, the equipment that takes care of monitoring and regulation of process conditions (within the glass or plastic microreactor or the micro-fluidic chip 134) is expensive.

Therefore it is desirable that the equipment that takes care of monitoring and regulation of the process conditions has a more durable character. This target can be reached by the inventive concept to have the process control device as a fixed part of the chip-holder, wherein the process control device can be separated from the micro-fluidic chip 134. As a consequence it is possible to exchange the cheap micro-fluidic chip 134 whenever it is necessary (e.g. when any of the fluid channels in the micro-fluidic chip 134 is blocked). In contrast, the expensive process control device 160 contained in the chip-holder can be reused. It should also be noted that the process control device 160 is detachable from the micro-fluidic chip 134, as no covalent bonds are formed between the process control device 160 and the micro-fluidic chip 134 when the process control device 160 is in direct contact with the micro-fluidic chip 134. This can be achieved by an appropriate choice of the materials of the process control device and the sealing materials used to connect the process control device 160 and the micro-fluidic chip 134. Also, process temperatures should not exceed a certain limit in order to avoid the formation of covalent bonds.

It should further be noted that a number of modifications can be introduced into the described chip-holder 100. In particular, it may be necessary to include fluid connections to bring fluids to inlets of the micro-fluidic chip 134 and to extract fluids from outlets of the micro-fluidic chip 134. Further, a mechanical set-up to fix the micro-fluidic chip 134 can be modified. It should further be noted that more than one process control device 160 can be used. The number of process control devices 160 is merely limited by the requirement that the process control devices 160 are in direct contact with the micro-fluidic chip 134. Furthermore, the chip-holder may comprise additional control circuitry which may be connected with the one or more process control devices 160. in this case, the process control device 160 may be attached to a printed circuit board (PCB).

Figure 2A:
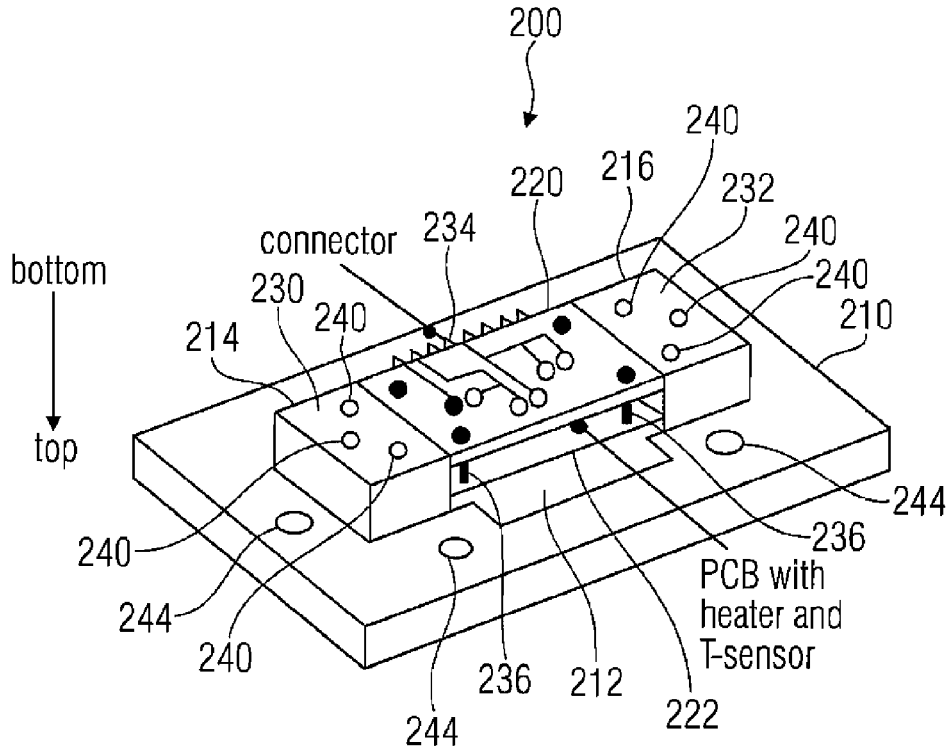
FIG. 2*a* shows a three-dimensional drawing of an upper part of an inventive chip-holder according to a second embodiment of the present invention.

FIG. 2*a* shows a three-dimensional drawing of an upper part of the inventive chip-holder according to a second embodiment of the present invention. The upper part is designated in its entirety with 200. The upper part 200 comprises a plate 210. The plate 210 has an opening 212 and two protrusions 214, 216. A stack of two printed circuit boards 220, 222 is fixed between the first protrusion 214 and the second protrusion 216. The first printed circuit board 220 comprises a heater and a temperature sensor. The first printed circuit board 220 is aligned such that surfaces of the heater and the temperature sensor are in one plane with surfaces 230, 232 of the protrusions 214, 216, wherein the surfaces 230, 232 of the protrusions 214, 216 are configured to contact a micro-fluidic chip which may be fixed by the chip-holder. The first printed circuit board 220 is electrically connected to the second printed circuit board 222 over a connector 234. Furthermore, circuit boards 220, 222 are mechanically connected by mechanical spacers 246. Both protrusions 214, 216 comprise a number of connection holes 240. The connection holes 240 are configured to allow a fluidic connection with a micro-fluidic chip which may be fixed in the chip-holder. The connection holes 240 are aligned such that thin pipes can be fed through the connection holes which connect a micro-fluidic chip. These thin pipes are typically made out of glass. However, other configurations are possible.

The plate 210 further comprises a plurality of fixing holes 244. The fixing holes 244 are configured to allow a connection of the upper part 200 with a lower part of a chip-holder. The fixing holes 244 may comprise a thread. However, the fixing holes are just an example for a means to fix the upper part 200 to a lower part of a chip-holder.

It should be noted that the first protrusion 214, the second protrusion 216 and the stack of printed circuit boards 220, 222 are configured in such a way that they form one big protrusion. Consequently, printed circuit boards 220, 222 do not consume any extra space compared with a conventional chip-holder having only one big protrusion. Accordingly, the inventive chip-holder is very compact.

Figure 2B:
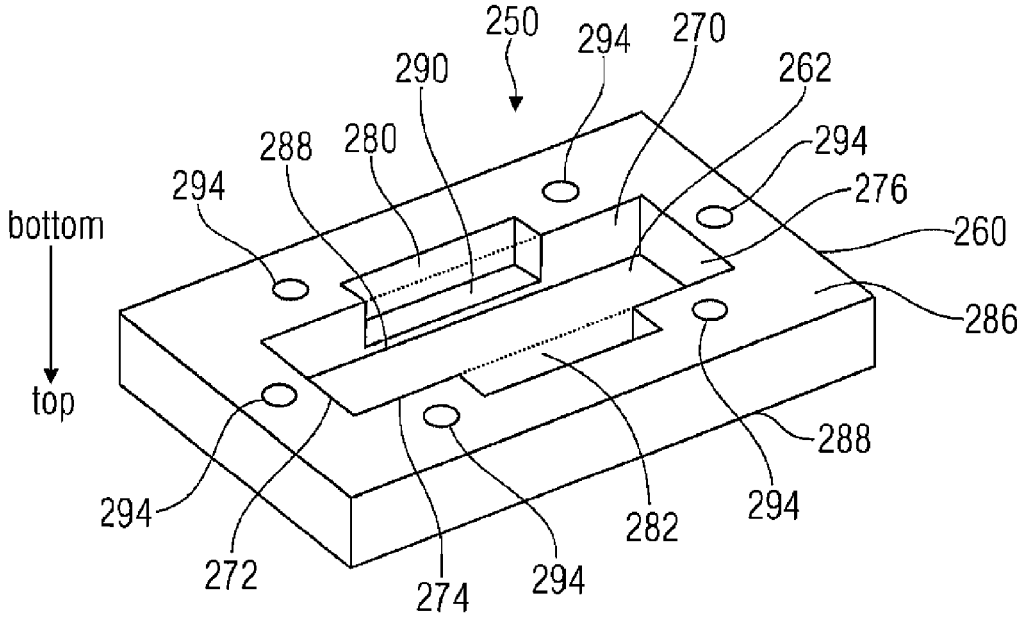
FIG. 2*b* shows a three-dimensional drawing of a lower part of an inventive chip-holder according to the second embodiment of the present invention.

FIG. 2*b* shows a three-dimensional drawing of a lower part of an inventive chip-holder according to the second embodiment of the present invention. The lower part of the chip-holder is designated in its entirety with 250. The lower part comprises a plate 260, the plate having a rectangular opening 262. the opening 262 is limited by four surfaces 270, 272, 274, 276. The first surface 270 and the third surface 274 are opposite of each other. The first surface 270 comprises a first recess 280. The third surface 274 comprises a second recess 282. The recesses 280, 282 start at a top surface 286 of the plate 260 but do not extend fully down to a bottom surface 288 of the plate 260. In contrast, a layer 290 of plate material is left between the bottom end of the first recess 280 and the bottom surface 288 of the plate 260. The same is true for the second recess 282.

The layer 290 of plate material can be used to fix a micro-fluidic chip in the first recess 280 and the second recess 282. Furthermore, the recesses 280, 282 are used for a connection 234 between the printed circuit boards 220, 222 of the upper part 200. Besides, the recesses 280, 282 allow air circulation to cool any circuitry contained on the printed circuit boards 220, 222 and to remove heat from the micro-fluidic chip.

The plate 260 further comprises a plurality of holes 294. The holes may comprise a thread to accept threaded bolts in order to mechanically connect the lower part 250 with the upper part 200 of the chip-holder. However, any other fixing mechanism may be used. In particular, it is irrelevant whether the upper part 200 or the lower part 250 comprises threaded holes, as long as it is possible to fix the upper part 200 and the lower part 250 together with some mechanical force.

It should be noted that the present invention does not necessarily necessitate the first protrusion 214 and the second protrusion 216 as long as it is ensured that the micro-fluidic chip can be fixed in the lower part 250 of the inventive chip-holder. Also, it should be noted that the terms upper part 200 and lower part 250 are chosen arbitrarily. The actual location of the two parts may vary according to the requirements of a particular application.

Figure 3:
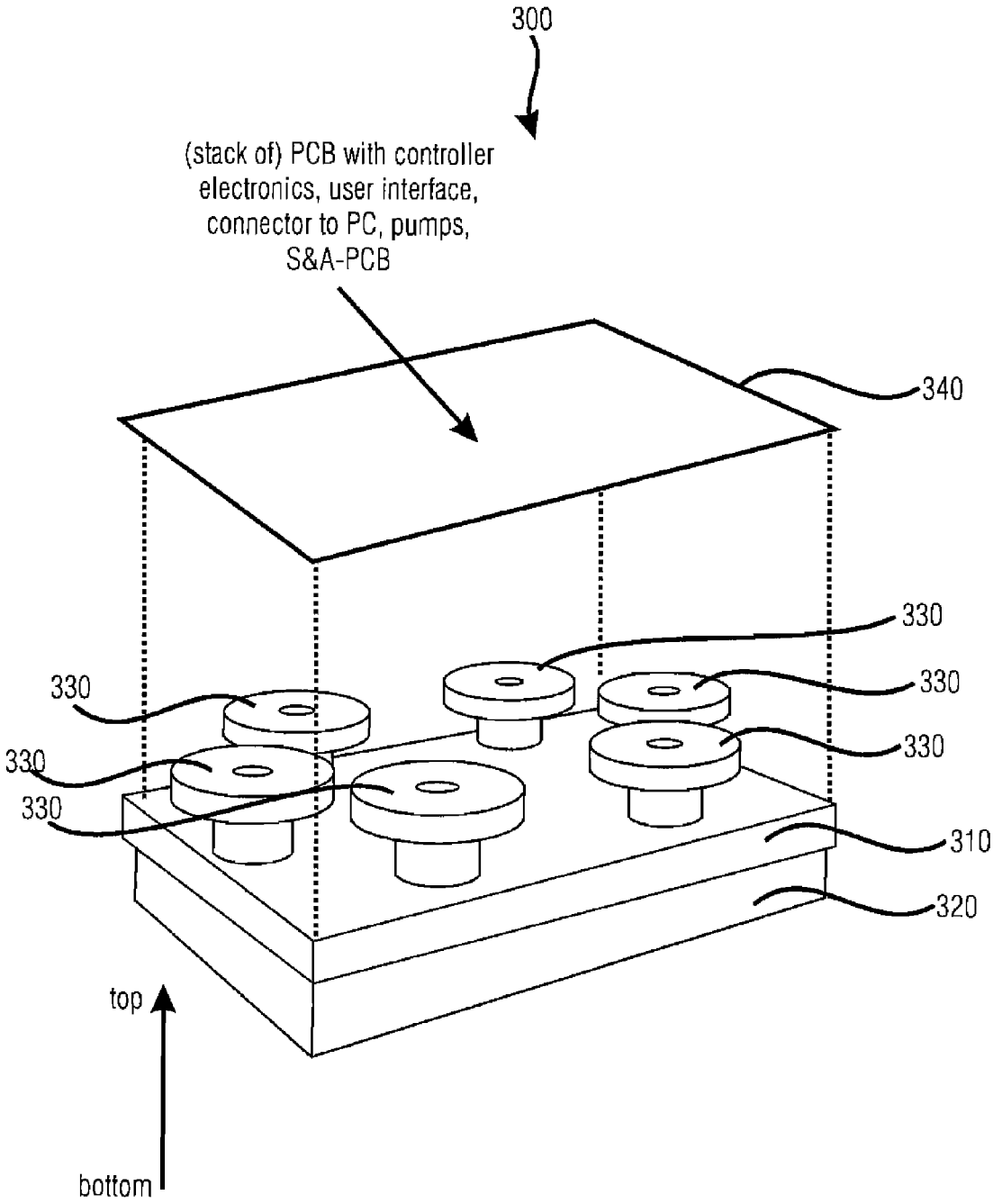
FIG. 3 shows a three-dimensional principle drawing of an assembled inventive chip-holder according to a third embodiment of the present invention.

FIG. 3 shows a three-dimensional principle drawing of an assembled inventive chip-holder according to a third embodiment of the present invention. The assembled chip-holder is designated in its entirety with 300. The assembled chip-holder 300 comprises an upper part 310 and a lower part 320. The upper part 310 may be identical to the upper part 200 shown in FIG. 2*a*. However, some minor amendments may apply. Similarly, the lower part 320 may be identical or similar to the lower part 250 shown in FIG. 2*b*.

It should further be noted that the lower part 320 comprises six threaded bolts which reach through six holes of the upper part 310. The upper part 310 is fixed to the lower part 320 using six knurled nuts 330. For illustration purposes, FIG. 3 further shows a printed circuit board 340 which may be fixed to the upper part 310. It should be noted that the printed circuit board 340 is not shown in its actual position. In contrast, it must be assumed that the printed circuit board 340 is actually fixed to the upper part 310 or the lower part 320. The printed circuit board 340 is advantageously attached to the upper part 310 such that it is in contact with a micro-fluidic chip which is fixed between the upper part 310 and the lower part 320. To be more specific, it is advantageous that process control devices fixed to the printed circuit board 340 are in contact with the micro-fluidic chip fixed between the upper part 310 and the lower part 320.

The printed circuit board 340 represents one printed circuit board or a stack of several printed circuit boards. The printed circuit boards may comprise controller electronics, a user interface, a connector to an external PC and/or one or more pumps. Furthermore, a sensor/actuator printed circuit board may be part of the stack of printed circuit boards. It should be noted that a wide variety of sensors and/or actuators may be attached to the printed circuit boards as long as it is ensured that the sensors or actuators are in direct contact with the micro-fluidic chip fixed between the upper part 310 and the lower part 320. In the case that the printed circuit board 340 is made of a stack of at least two printed circuit boards, it is also possible to have only a sensor/actuator printed circuit board in contact with the microfluidic chip fixed between the upper part 310 and the lower part 320 while the remaining printed circuit board or boards containing e.g. controller electronics, user interface, connector to an external PC and/or one or more pumps can be connected to the outside of the upper part 310 or the lower part 320.

FIGS. 4*a*, 4*b*, 4*c*, 4*d*, 4*e* and 4*f* show six three-dimensional drawings of the inventive chip-holder according to the third embodiment of the present invention. It should be noted that throughout the description the same reference numerals designate identical means, and that means will only be explained one time.

Figure 4A:
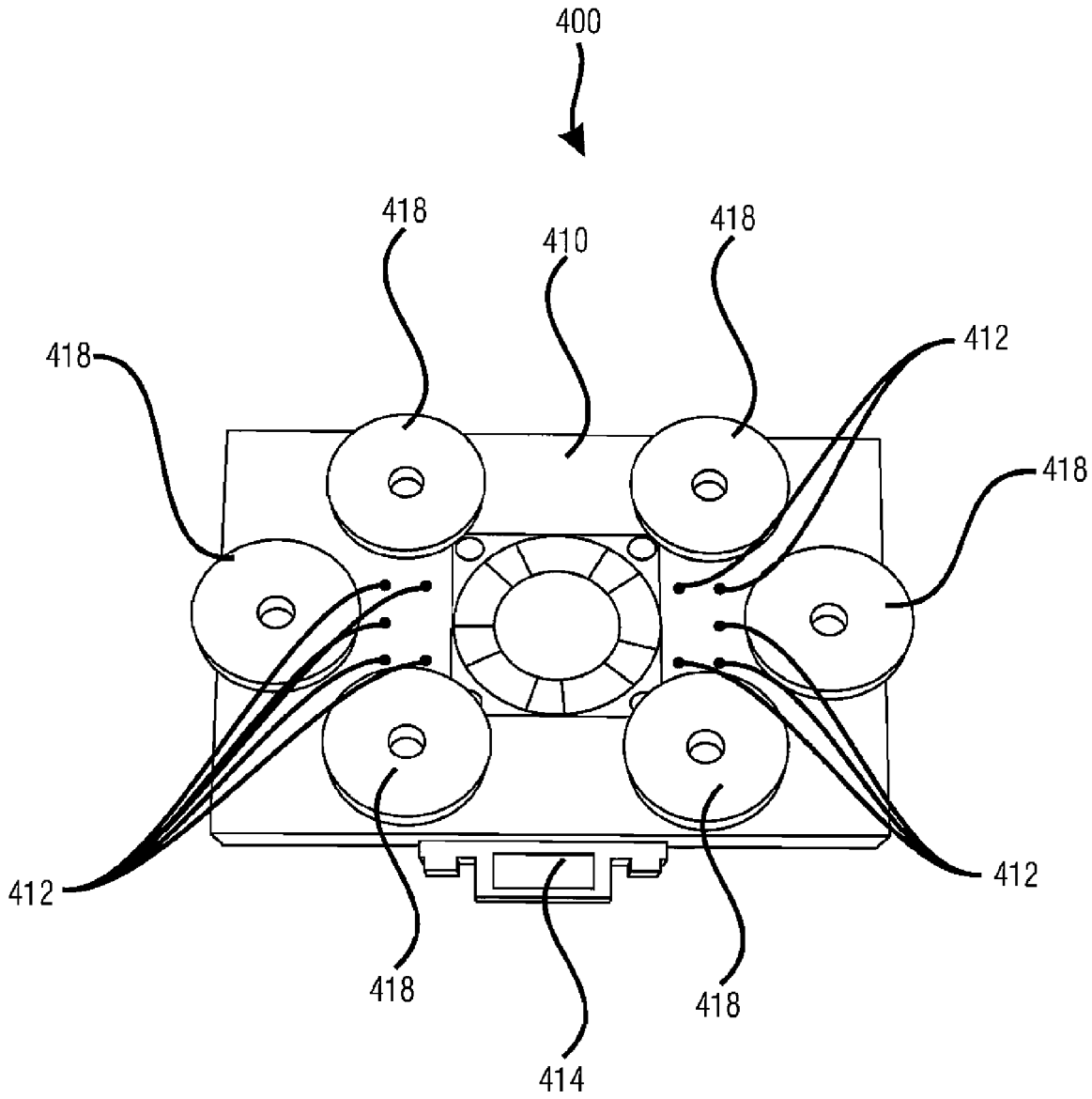
FIG. 4*a* shows a three-dimensional drawing of the inventive chip-holder according to the third embodiment of the present invention.

FIG. 4*a* is a top-view of an assembled inventive chip-holder. The drawing of FIG. 4*a* is designated in its entirety with 400. The drawing 400 shows the upper plate 410 of the assembled chip-holder. The upper plate comprises a plurality of connection holes 412, wherein connection holes 412 can be used to make a fluid connection to a micro-fluidic chip fixed in the chip-holder. Then glass pipes can be put through the connection holes 412 and contact the micro-fluidic chip. A sealing may be used in order to avoid leakage. Also, the thin glass pipes may be fixed in the connection holes 412 permanently or detachably using materials like rubber, silicone or glue. Of course, other materials may be used for fixing the thin glass pipes in the connection holes 412.

The drawing 400 further shows a D-SUB connector 414 attached to the upper plate 410. Besides, a fan 416 is attached to the upper plate 410. The fan is configured to generate an air ventilation through the chip-holder in order to cool down the electronic components. The fan can further be used in order to cool down one end of a Peltier element which may in turn be used to cool down the micro-fluidic chip fixed in the chip-holder. It should be noted that there is an opening reaching through the upper plate 410 in order to allow an air circulation. Furthermore, there is at least one additional recess in order to allow an air circulation.

Drawing 400 also shows six knurled nuts 418. The knurled nuts 418 are used to fix the upper plate 410 to a lower part. For this purpose, the knurled nuts 418 are screwed to threaded bolts which are in turn fixed to the lower part.

Figure 4B:
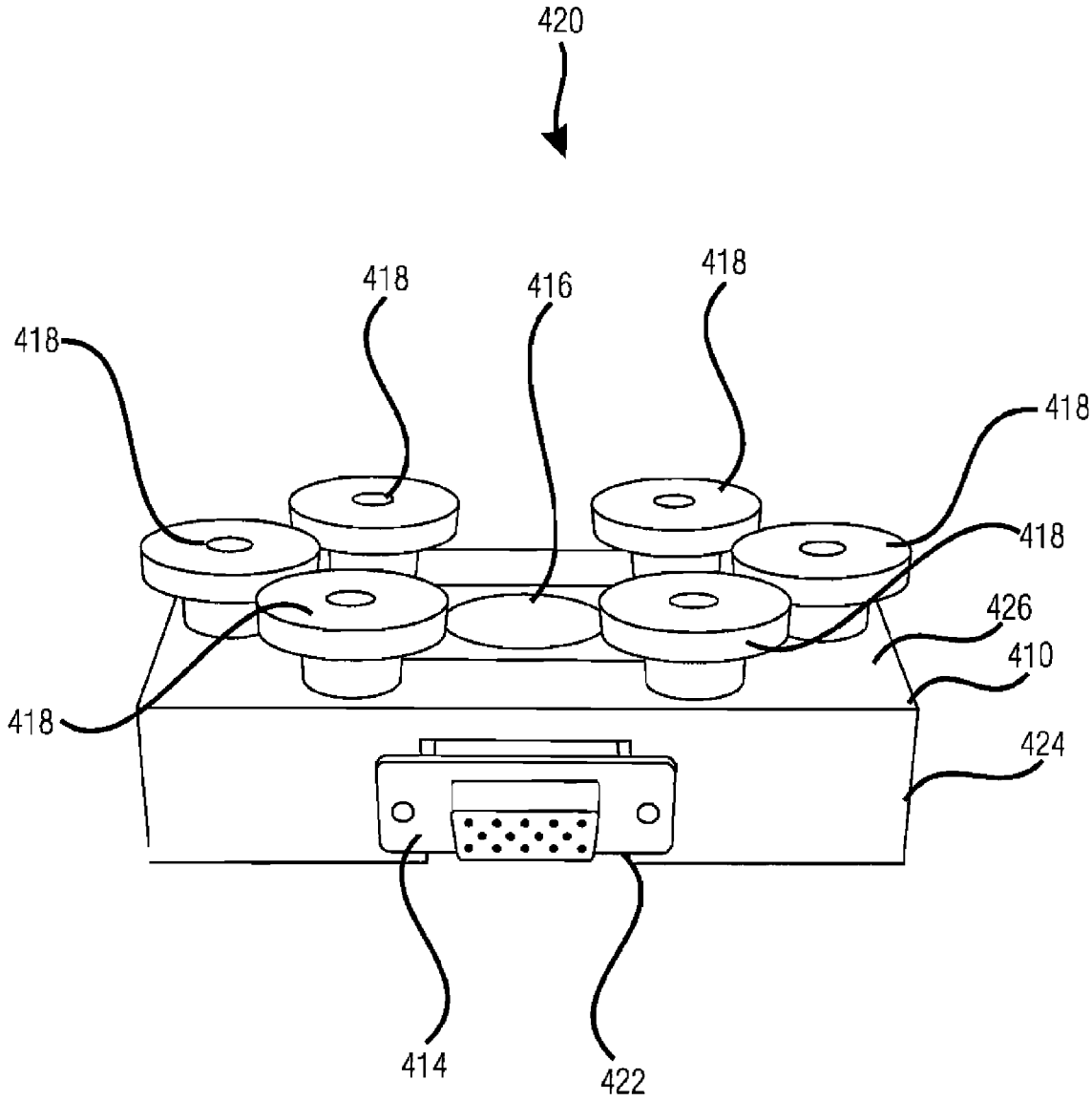
FIG. 4*b* shows a second three-dimensional drawing of the inventive chip-holder according to the third embodiment of the present invention.

FIG. 4*b* shows a second drawing of the assembled chip-holder. The drawing of FIG. 4*b* is designated in its entirety with 420. The drawing 420 is an oblique view of the inventive chip-holder. It can be seen that the upper plate 410 is configured such that it can be used to fix the D-SUB connector 414. The D-SUB 414 connector is located in a recess 422 in one side surface 424 of the upper plate 410. In other words, it is advantageous that the D-SUB connector 414 is located at a side surface of the upper plate 410 rather than at the top surface 426 of the upper plate. The advantageous position of the connector reduces the cabling effort in connecting a printed circuit board with the D-SUB connector 414. Furthermore, it should be noted that placing the connector 414 at the side surface 422 avoids any mechanical conflict between the connector and the knurled nuts 418.

Figure 4C:
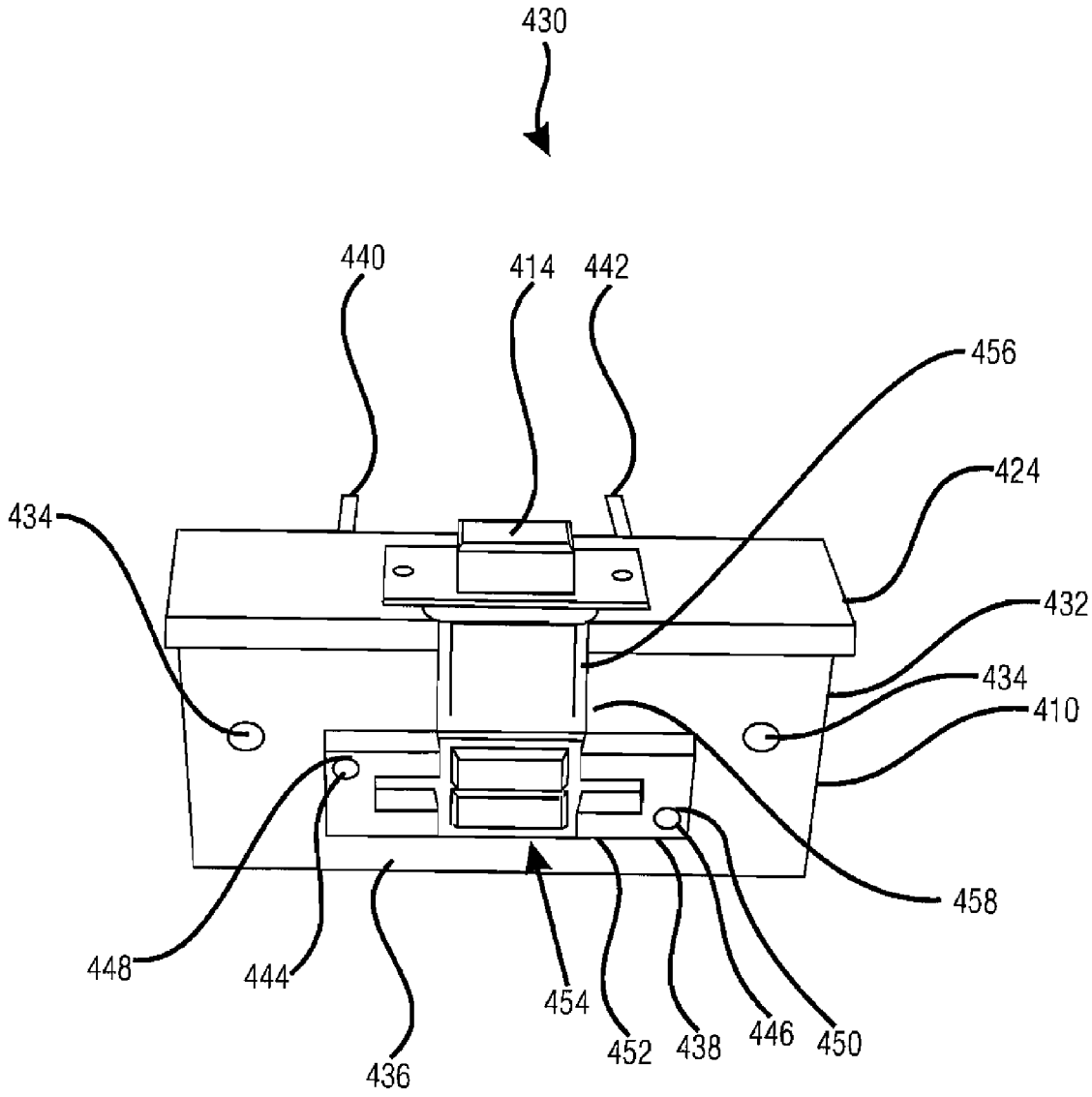
FIG. 4*c* shows a third three-dimensional drawing of the inventive chip-holder according to the third embodiment of the present invention.

FIG. 4*c* shows a bottom-view of the upper plate 410 of the inventive chip-holder. The drawing of FIG. 4*c* is designated in its entirety with 430. The drawing 430 shows a bottom surface 432 of the upper plate 410. The upper plate 410 comprises fixing holes 434 which are formed between the bottom surface 432 and the top surface 426. The bottom surface 432 also shows two U-shaped protrusions 436, 438. The protrusions 436, 438 are configured to transfer mechanical force to a micro-fluidic chip when the micro-fluidic chip is fixed in the chip-holder. The protrusions comprise holes in which thin glass pipes are fixed. The thin glass pipes are designated with 440 and 442. One end of each glass pipe 440, 442 extends outward from the top surface 426 of the upper place 410. The second ends of the glass pipes 440, 442 extend through the respective holes in the protrusions 436, 438. These ends of the glass pipes 440, 442 are designated with 444, 446. It can further be seen that the ends 444, 446 of the glass pipes 440, 442 are fixed in the holes of the protrusion 436, 438 using fixing means 448, 450. The ends 444, 446 of the glass pipes 440, 442 can contact openings of a micro-fluidic chip which may be fixed in the chip-holder. In this case, there is a fluid connection between the glass pipes 440, 442 and the fluid channels of the micro-fluidic chip. Sealing may be achieved by the fixing means 448, 450 or by separate dedicated sealing means.

It can furthermore be seen in the drawing 430 that a printed circuit board 452 is attached to the lower plate 410. The printed circuit board comprises a temperature sensor as well as a heater/cooler means 454, wherein the temperature sensor and the heater/cooler means 454 are attached to the printed circuit board. Furthermore, there is a cabling 456 between the printed circuit board 452 and the D-SUB connector 414.

Besides, a ventilation opening 458 can be seen in the upper plate 410. The ventilation opening is placed so that an airflow generated by the fan 416 efficiently cools the printed circuit board 452.

It should further be noted that the heater/cooler means 454 and the temperature sensor are aligned such that they are in direct contact with a micro-fluidic chip when the micro-fluidic chip is fixed in the inventive chip-holder.

Figure 4D:
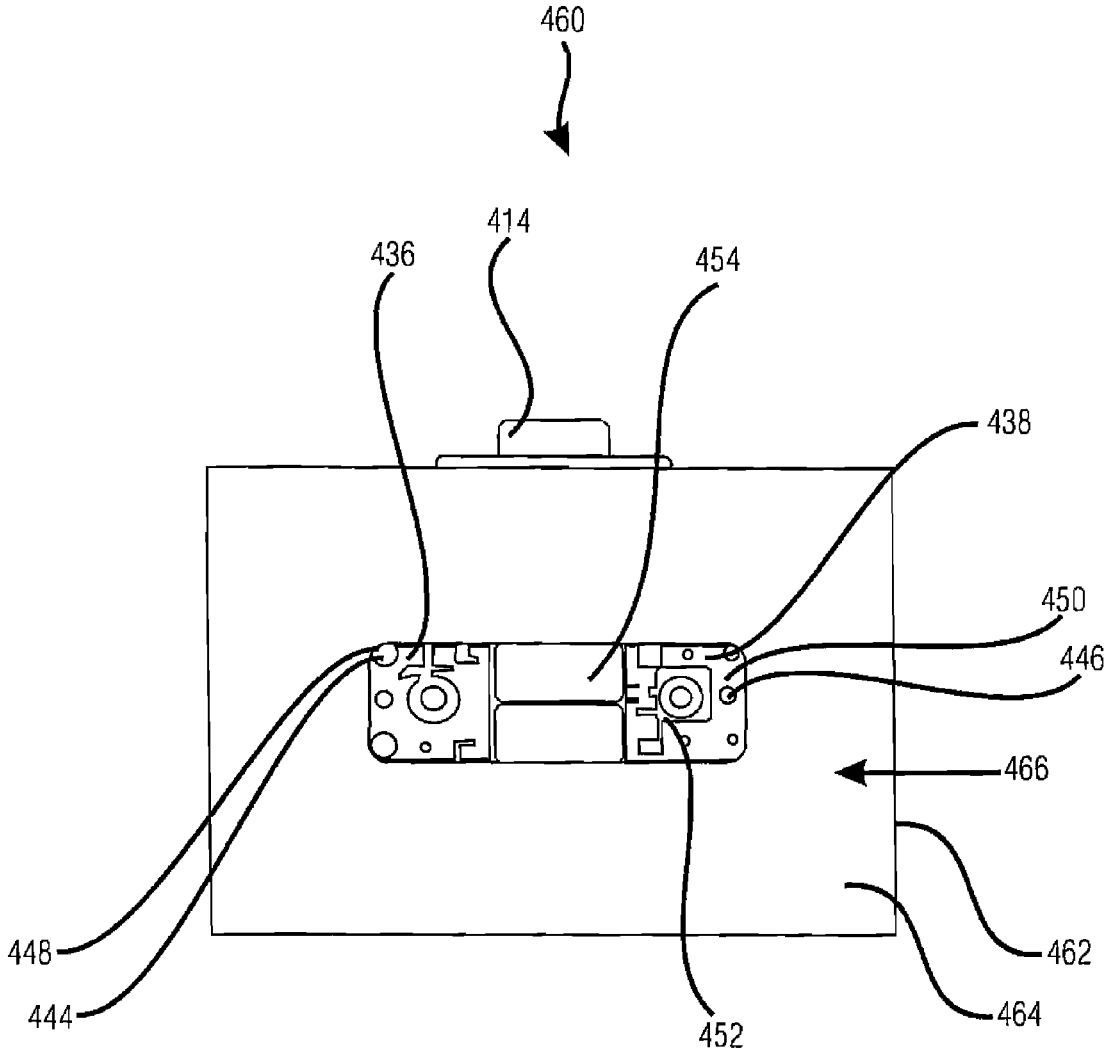
FIG. 4*d* shows a fourth three-dimensional drawing of the inventive chip-holder according to the third embodiment of the present invention.

FIG. 4*d* shows a bottom-view of an inventive chip-holder. The drawing of FIG. 4*d* is designated in its entirety with 460. The drawing 460 of the assembled chip-holder shows a bottom plate 462, the bottom surface 464 of which can be seen in the drawing 460. The bottom plate 462 provides an opening 466 which allows an optical inspection of a micro-fluidic chip when the micro-fluidic chip is inserted into the chip-holder. Furthermore, it should be noted that in the absence of a micro-fluidic chip (or in the case of a transparent micro-fluidic chip) means of the upper plate 410 can be seen through the opening 466. As these means have already been described in detail previously, a repetition will be omitted here and reference is made to the description of FIG. 4*c*.

Figure 4E:
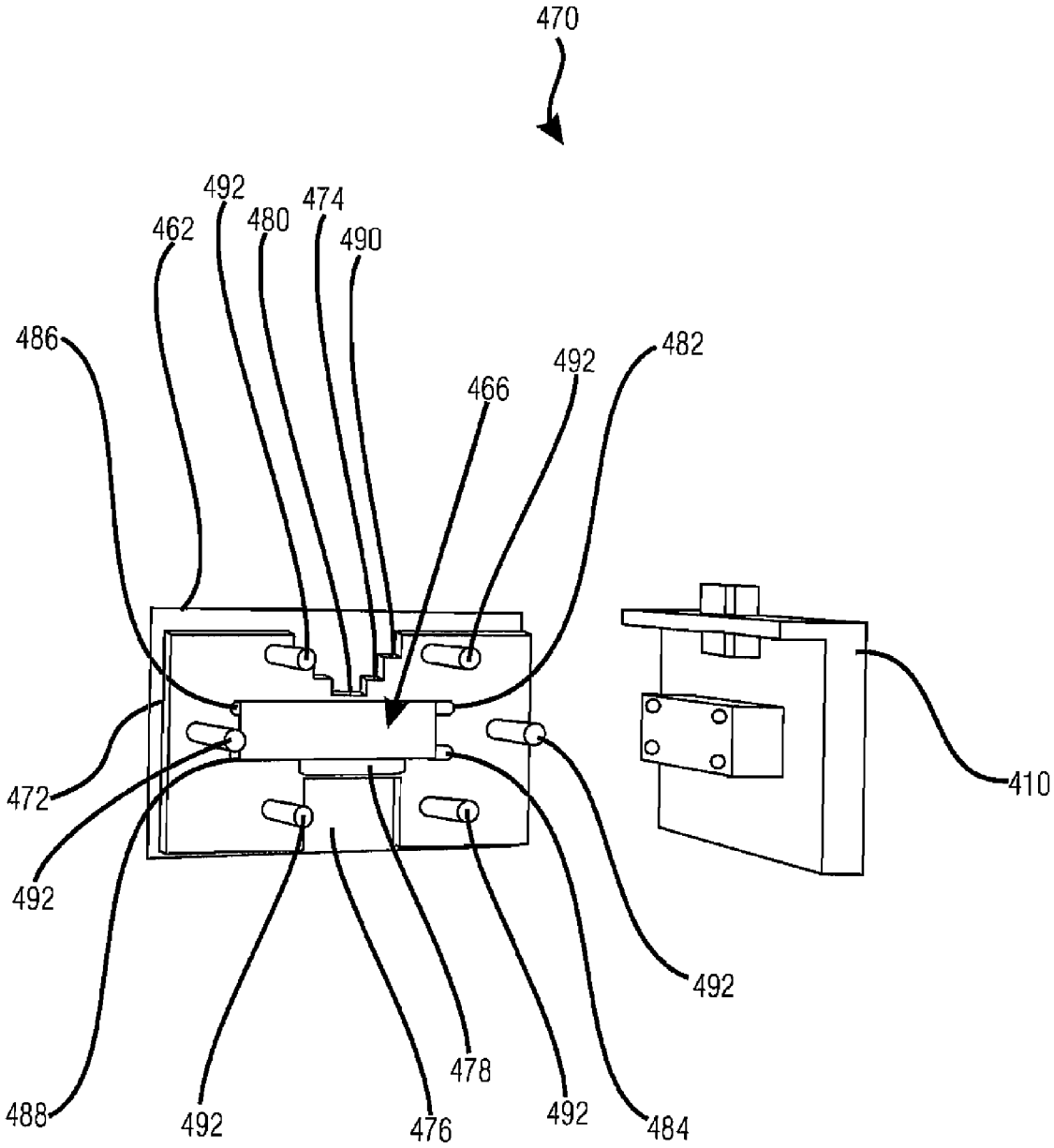
FIG. 4*e* shows a fifth three-dimensional drawing of the inventive chip-holder according to the third embodiment of the present invention.

FIG. 4*e* shows a drawing of the upper plate 410 and the lower place 462 in a disassembled condition. The drawing of FIG. 4*e* is designated in its entirety with 470. The drawing 470 shows the upper plate 410 and the lower plate 462. As the upper plate 410 has already been described in much detail, an additional description will be omitted here, and reference is made to the description of FIGS. 4*a*, 4*b* and 4*c*. In the drawing 470 it can be seen that the lower plate 462 comprises a number of recesses in its upper surface 472 (the surface that is adjacent to the upper plate when the chip-holder is assembled). First of all it should be noted that cooling recesses 474, 476 are formed in the upper surface 472 of the lower plate 462. Additional deeper recesses 478, 480 are formed on the upper surface 472 of the lower plate 462. The deeper recesses 478, 480 are adjacent to the opening 466 of the lower plate 462. The deeper recesses 478, 480 are configured to fix a carrier means which may carry the micro-fluidic chip. Further recesses 482, 484, 486, 488 are placed next to the corners of the opening 466. These recesses 482, 484, 486, 488 facilitate the fabrication of the lower plate 462 of the chip-holder. Another connector recess 490 in the upper surface 472 of the lower plate 462 gives space for the D-SUB connector 414 which is attached to the upper plate 410.

Furthermore, it should be noted that threaded bolts 492 are fixed to the lower plate 462 and the threaded bolts 492 attached to the lower plate 462 allow a connection of the lower plate 462 and the upper plate 410.

Figure 4F:
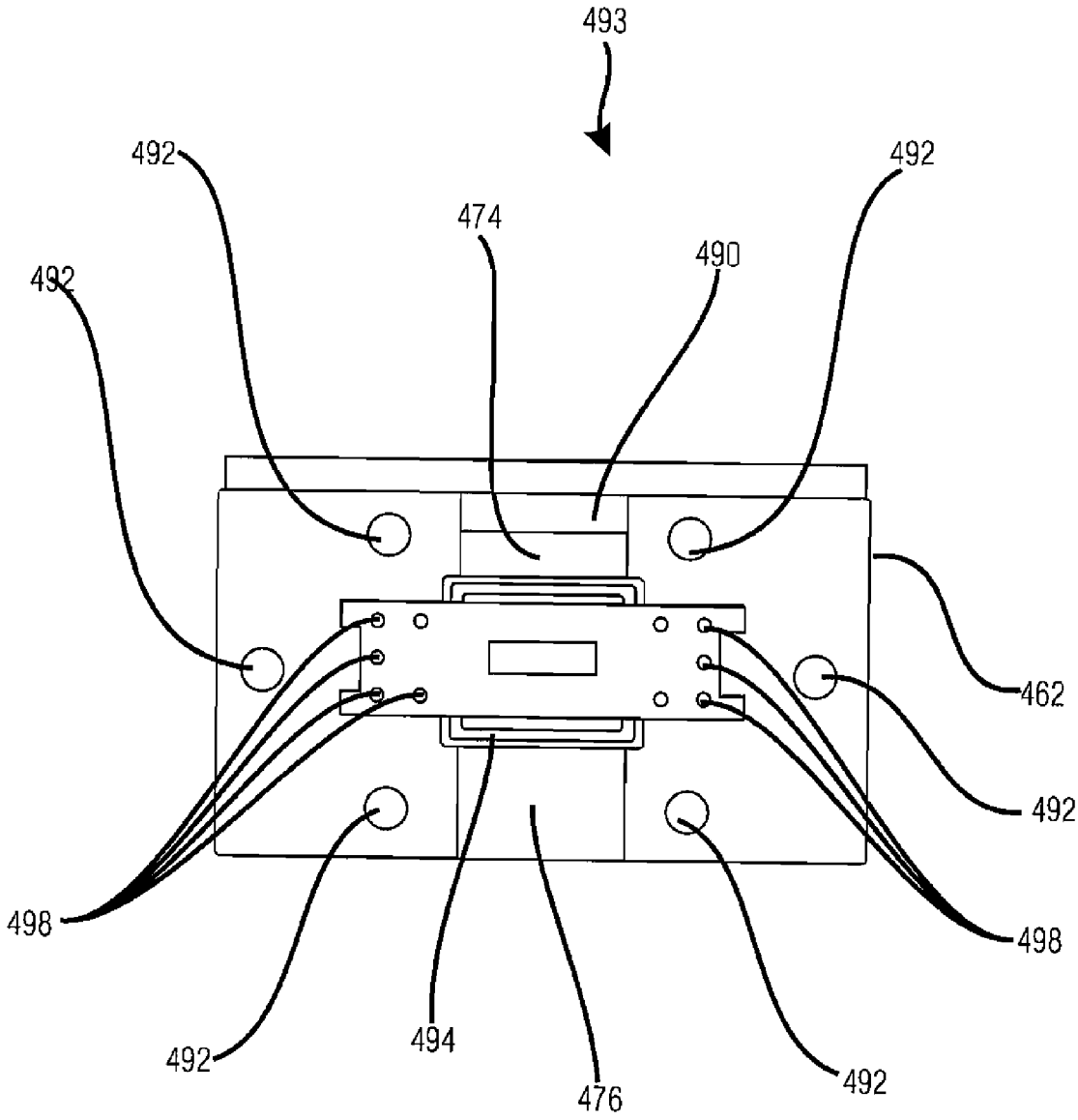
FIG. 4*f* shows a sixth three-dimensional drawing of the inventive chip-holder according to the third embodiment of the present invention.

FIG. 4*f* shows a top-view of the lower plate 462. The drawing of FIG. 4*f* is designated in its entirety with 493. The drawing 493 shows the lower plate 462 as described with reference to FIG. 4*e*. Therefore, any means described above are designated with the same reference numerals in FIG. 4*f* and will not be explained here again. However, the drawing 493 further shows a chip-carrier 494 which is fixed in its position by the deep recesses 478, 480. The chip-carrier 494 carries a micro-fluidic chip 496. The micro-fluidic chip 496 is fixed to its position by the edges of the opening 466. Furthermore, it should be noted that the micro-fluidic chip 496 comprises a plurality of inlets/outlets 498. Inlets and outlets can be coupled to the ends 444, 446 of thin glass pipes 440, 442 when the lower plate 462 is assembled with the upper plate 410 with the micro-fluidic chip 496 in between.

Figure 5:
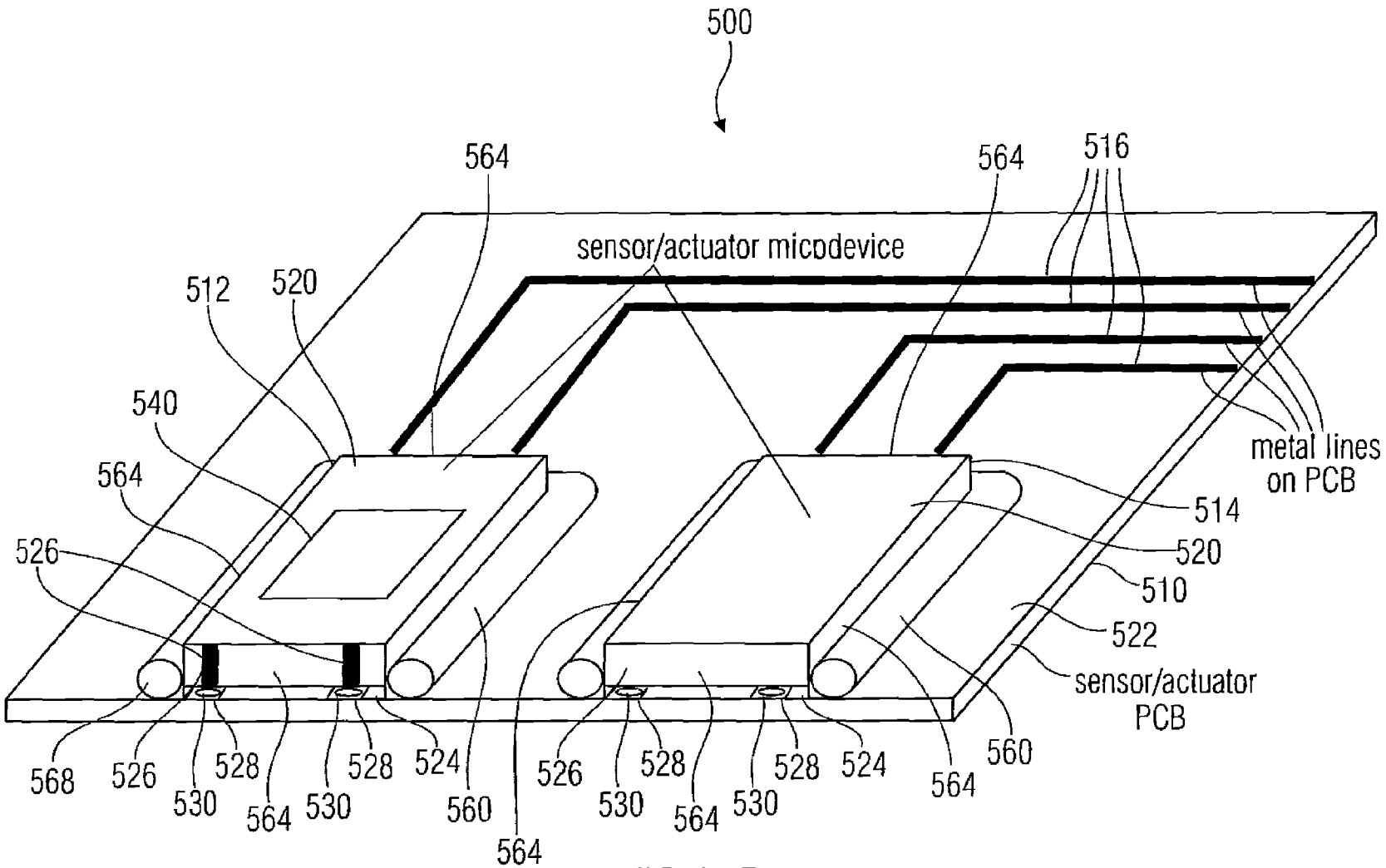
FIG. 5 shows a three-dimensional principle drawing of a printed circuit board carrying process control devices for usage in the inventive chip-holder.

FIG. 5 shows a technical principle drawing of a printed circuit board carrying process control devices for usage in the inventive chip-holder. The drawing of FIG. 5 is designated in its entirety with 500. FIG. 5 shows a printed circuit board 510 carrying a first process control device 512 and a second process control device 514. The printed circuit board 510 further carries metal lines 516 which make an electrical connection with the process control devices 512, 514. It should be noted here that the process control devices 512, 514 may advantageously be sensor or actuator microdevices.

The first process control device 512 comprises an active sensor/actuator area 540 on a device top surface 520, which is removed from the printed circuit board top surface 522. However, electrical connections are routed from the sensor top surface 520 of the first process control device 512 to a device bottom surface 524 of the first process control device 512. For this routing of signals through-wafer interconnects 526 are used. The through-wafer interconnects 526 are connected with contact pads 528 on the top surface 522 of the printed circuit board (PCB) 510 using bumps 530 or conducting adhesive. In other words, the electrical connection between the process control devices 512, 514 and the contact pads 528 of the printed circuit board 510 is based on flip-chip or conducting adhesive technique.

The second process control device 514 comprises an active sensor/actuator area 540 which is located at the device bottom surface 524 of the second process control device 514. Accordingly, the formation of through-wafer interconnects is not necessary for the second process control device 514. In contrast, a direct connection can be made between the device bottom surface 524 of the second process control device 514 and the contact pads 528. It should be noted here that the device bottom surface 524 of the second process control device 514 is still defined as the surface of the second process control device 514 which is adjacent to the top surface 522 of the printed circuit board 510. Conducting structures on the device bottom surface 524 of the second process control device 514 are connected with contact pads 528 of the printed circuit board 510 using bumps 530 or conducting adhesive. In other words, the connection technology for forming an electrical connection between the first process control device 512 and the metal lines 516 of the printed circuit board differs from the connection technology applied with the second process control device 514 merely by the fact that through-wafer interconnects 526 need to be applied when the active sensor/actuator area 540 is on a surface of the process control device which is remote from the top surface 522 of the printed circuit board 510. Therefore, depending on the particular application, the geometry of the first process control device 512 or of the second process control device 514 may be more advantageous. If the active sensor/actuator area 540 is on the device top surface 520, the active area 540 is closer to the micro-fluidic chip which may be fixed in a chip-holder comprising the printed circuit board 510. Accordingly, the sensor can react faster in this case and measure the process conditions within the micro-fluidic chip more accurately. Similar considerations are true for an actuator device. However, having the active sensor/actuator area 540 next to the printed circuit board top surface 522 may also be advantageous. In this case, the active sensor/actuator area 540 is protected from any environmental impact when the micro-fluidic chip is removed. As a consequence, the risk of damage of the active sensor/actuator area 540 can be reduced.

Also, an overfiller layer can be added: a compound on the printed circuit board between the electronic components. The layer fills in the gaps between the sensors and actuators, forming a completely flat surface which is coupled to the microfluidic chip. This can reduce the pressure on the sensors or actuators.

It should further be noted that an underfiller 550 can optionally be introduced between the device bottom surface 524 and the printed circuit board top surface 522. The underfiller 550 can reduce mechanical stress on the bumps 530. Furthermore, the underfiller 550 may protect the bumps 530 from any external impact. In particular, the underfiller may prevent that any fluids get in contact with the bumps 530. This is important if the active sensor/actuator area 540 is located at the device bottom surface 524, because in this case fluid may be in contact with the device bottom surface 524.

Each process control device 512, 514 may be surrounded by a sealing ring 560. The sealing ring 560 is a flexible polymer (e.g. silicone) ring which seals the printed circuit board tightly at corresponding openings in the cover plate of the microreactor. The sealing ring encircles the chips which constitute the first process control device 512 and the second process control device 514. The sealing rings 560 are in contact with the top surface 522 of the printed circuit board 510 and side surfaces 564 of the process control devices 512, 514. The sealing rings 560 may also contact the optional underfiller 550. This can be seen from FIG. 5. A cross-section 568 of the sealing rings 560 may be circular or elliptical. It should further be noted that the sealing rings 560 can be considered to be an integrated sealing.

The sealing rings 560 prevent a leakage of a fluid from the micro-fluidic chip when the micro-fluidic chip is brought into contact with the printed circuit board 510. In this case, fluid guiding structures of the micro-fluidic chip are in contact with the sealing ring. If some pressure is applied, a fluid sealing will occur between the micro-fluidic chip and the sealing ring. However, it should be noted that the sealing is detachable as no permanent covalent bonds are formed between the micro-fluidic chip and the sealing rings 560. Accordingly, the micro-fluidic chip and the printed circuit board 510 can be separated whenever the micro-fluidic chip has to be exchanged.

Figure 6:
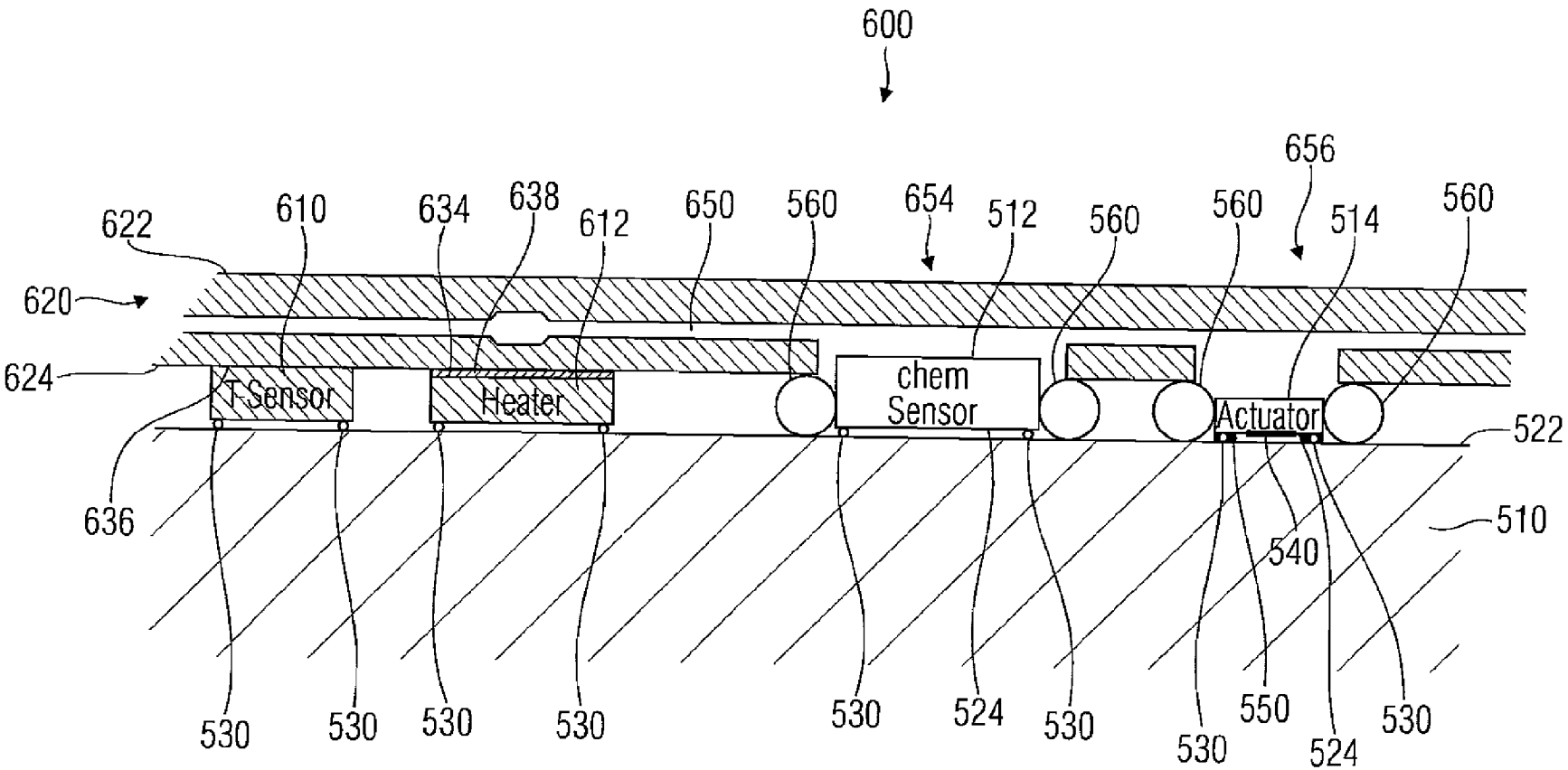
FIG. 6 shows a cross-section of a printed circuit board carrying process control devices in contact with a micro-fluidic chip when used in an inventive chip-holder.

FIG. 6 shows a cross-section of a printed circuit board carrying process control devices in contact with a micro-fluidic chip when used in an inventive chip-holder. The drawing of FIG. 6 is designated in its entirety with 600. The drawing 600 comprises a number of components which were already explained with reference to the drawings 500. Drawing 600 shows, for example, a printed circuit board 510 having a printed circuit board top surface 522, a first process control device 512 and a second process control device 514 connected to contact pads of the printed circuit board 510 using bumps 530 and sealing rings 560. It should be noted that identical means are designated with the same reference numerals throughout the description. Drawing 600 further shows a temperature sensor 610 attached to the printed circuit board 510 using bumps 530. Similarly, a heater 612 is attached to the printed circuit board 510.

Drawing 600 further shows a part of a micro-fluidic chip 620 having a top surface 622 and a bottom surface 624. The bottom surface 624 is adjacent to the printed circuit board top surface 522. It can be seen from the drawing 600 that a top surface 630 of the temperature sensor 610 is in direct mechanical and thermal contact with the bottom surface 624 of the micro-fluidic chip 620. Alternatively, a thin heat-conducting means may be between the top surface 630 of the temperature sensor 610 and the bottom surface 624 of the micro-fluidic chip 620.

Such a solution is shown for the heater 612. A top surface 634 of the heater 612 is coupled to the bottom surface 624 of the micro-fluidic chip over a thermally-conducting means 638. The thermally-conducting means 638 may comprise a thermally well-conducting metal like copper or aluminum. Also, an alloy of these materials could be used, as well as other thermally-conductive materials. For example, a thermally-conducting plastic material could be used. Besides, a heat-conducting paste could form the thermally-conducting means. Of course, thermally-conducting means 638 can also be a combination of different thermally-conducting materials.

Furthermore, drawing 600 of FIG. 6 illustrates how a first process control device 512, which may, for example, be a chemical sensor, and a second process control device 514, which may, for example, be a fluidic actuator, can be coupled with a fluid channel 650 of the micro-fluidic chip 620. It can be seen from FIG. 6 that the micro-fluidic chip 620 comprises a first opening 654 and a second opening 656. Around the openings 654, 656 the bottom surface 624 of the micro-fluidic chip 620 is in contact with corresponding sealing rings 560. As described above, the sealing rings are furthermore in contact with the chips that constitute the first process control device 512 and the second process control device 514. The sealing rings 560 are also in direct contact with the top surface 522 of the printed circuit board 510. Accordingly, a fluid flowing in the fluid channel 650 can not leak out, but is restricted to the area limited by the fluid channel 650, the sealing rings 560 and the process control devices 512, 514. Furthermore, in some cases it is possible that the active area 540 of the process control devices 512, 514 is on the bottom surface 524 of the process control devices 512, 514. In this case, there must be a means to allow a flow of the fluid to the bottom surface 524 of the process control devices 512, 514. Accordingly, the fluid may also be restricted by the top surface 522 of the printed circuit board 510. In this case, an underfiller 550 may be present to further restrict the fluid and avoid that the fluid gets in contact with the bumps 530.

It should be noted that the openings 654, 656 can be in the vicinity of a reactor channel of the micro-fluidic chip. It is also possible that the openings are in direct contact with the reactor channel. That means that the openings are in contact with the chemicals flowing in the fluid channels.

Figure 7:
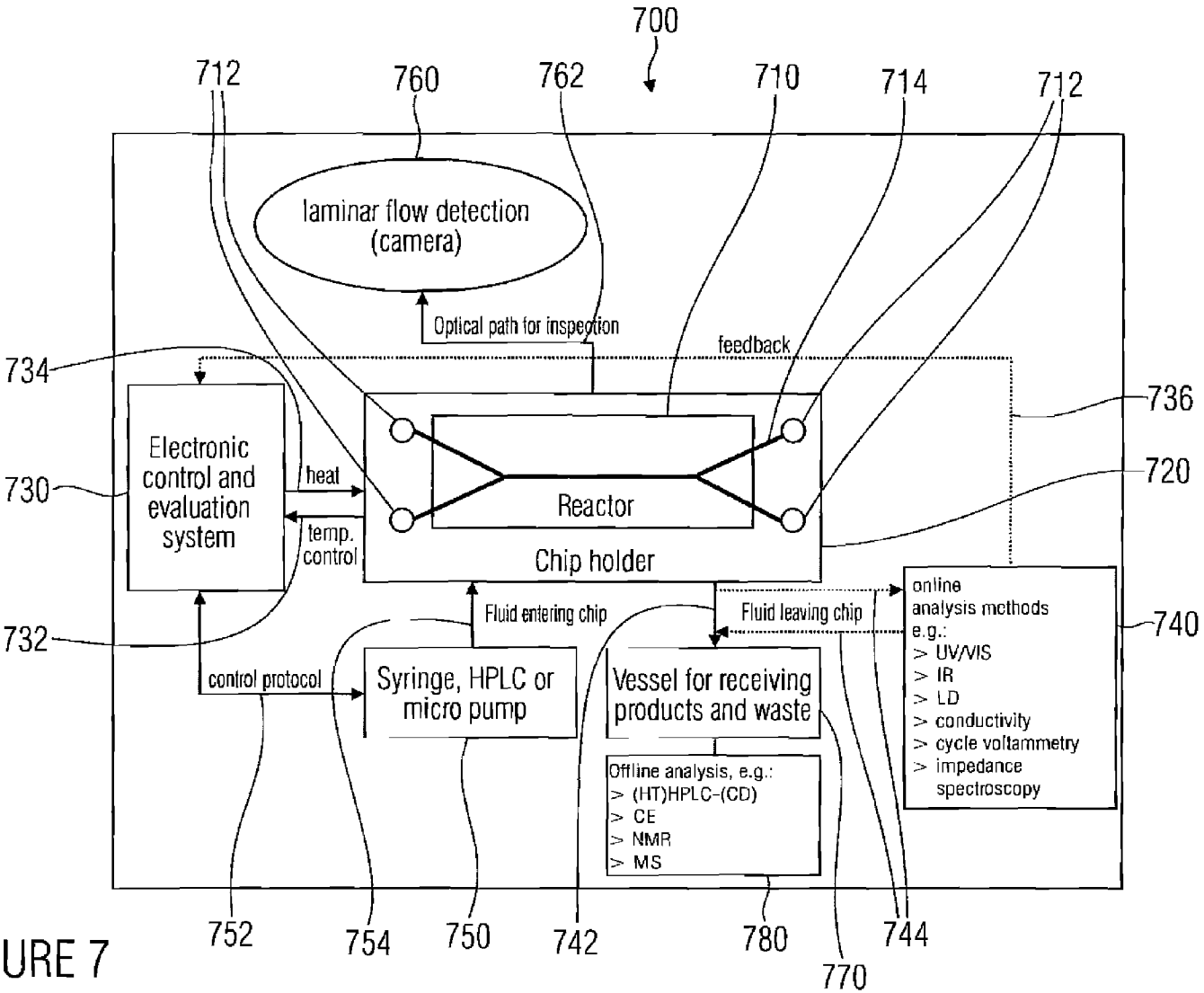
FIG. 7 shows a system diagram of a chemical microreactor system comprising an inventive chip-holder.

FIG. 7 shows a system diagram of a chemical reactor system comprising an inventive chip-holder. The system of FIG. 7 is designated in its entirety with 700. In other words, FIG. 7 shows a block scheme of a microreactor set-up. A reactor 710 is the center of the system 700. It should be noted that the reactor may also be a microreactor. The reactor comprises a plurality of fluid connections 712. The fluid connections 712 may be inlets or outlets and are typically connected with one or more fluid channels 714 within the reactor (microreactor) 710. It should further be noted that the reactor (microreactor) 710 is typically implemented in the form of a micro-fluidic chip. This micro-fluidic chip is fixed in a chip-holder 720. Another part of the system 700 is an electronic control and evaluation system designated with 730. The electronic control and evaluation system 730 monitors a temperature of the reactor 710. The temperature control is visualized by the temperature control arrow 732. The electronic control and evaluation system 730 is configured to apply heating or cooling to the reactor 710. This is visualized by the heat exchange arrow 734. The electronic control and evaluation system 730 further receives online analysis data. This is visualized in FIG. 7 by the analysis data arrow 736. Online analysis methods 740 are applied to fluid leaving the chip. The fluid leaving the chip is shown by the leaving fluid arrow 742. Fluid passing through one of the online analysis methods 740 is shown by analysis fluid arrows 744. It should further be noted that online analysis methods 740 may, for example, comprise an analysis with ultraviolet light or visible light (UV/VIS). Furthermore, infrared light (IR) can be used for chemical analysis. Also, circular dichroism (CD) can be evaluated for chemical analysis purposes. Besides, the conductivity of the fluid leaving the chip can be measured in order to yield an information about the physical and/or chemical characteristics of the fluid. For the same purpose, cyclic voltammetry or impedance spectroscopy can be applied.

The electronic control and evaluation system 730 can also control one or more pumps 750 over a pump control part 752. A pump control protocol is applied when sending control information to the pumps or receiving monitoring information from the pumps over the pump control path 752. At least one pump 750 is responsible for determining the flow 754 of fluid entering the reactor 710 or the micro-fluidic chip. The pump 750, can for example be a syringe pump, an HPLC pump or a micropump.

It should be noted that, due to the evaluation of results of an online analysis 740, a feedback loop can be closed. Process conditions, for example the temperature and the flow 754 of fluid entering the chip, can be adjusted in response to the results of the online analysis 740. Accordingly, the process conditions can be adjusted in such a way that necessitated process results are available.

The system 700 is completed by some additional equipment. For example, it may be necessary to monitor the flow within the reactor. A camera may be used in order to detect whether a laminar flow is present, which may be necessitated for optimal reaction results. The laminar flow detection is designated with 760 in FIG. 7. For the laminar flow detection 760 an optical path 762 is necessitated between the reactor (microreactor; micro-fluidic chip) and the camera.

Furthermore, it should be noted that one or more vessels 770 may be used for receiving reaction products and waste products. An offline analysis 780 can be performed on any fluids leaving the chip. In this context, the term "offline analysis" indicates that the results of the offline analysis 780 are not used in a closed control loop. However, of course, the results of the offline analysis may be used to adjust process parameters manually. Offline analysis methods comprise (HT) HPLC-(CD), capillary electrophoresis (CE), NMR or MS (i.e. MALDI-TOF).

The inventive system, comprising an electronic control and evaluation system 730 in direct contact with the reactor (microreactor; micro-fluidic chip) allows a very accurate closed-loop control of the process conditions in the reactor 710. Delay times are kept very low due to the close contact of the electronic control and evaluation system and the reactor. Furthermore, it should be noted that no external control circuitry is necessary, as the electronic control and evaluation system 730 is included in the chip-holder 720.

In the following, some more details about the modules used in the system 700 will be described. The reactor 710 (also designated as microreactor due to its small dimensions and the fact that the reactions are typically running in fluid channels rather than in a big reaction tank) is configured to tolerate a temperature range between −40° C. and 150° C. The reactor 710 is compatible with a large variety of chemicals. Indeed, all chemicals which are normally used in glassware can be used. With respect to process properties it can be stated that the inventive reactor (microreactor) 710 is suitable for all single-phase, two- or multiple-phase (two immiscible fluids) processes using homogenous liquids. The used reactor (microreactor) can also offer a high degree of flow control. Indeed, the behavior of the fluids can be controlled due to special separating structures inside the microchannels of the reactor 710. The flow speed can be adjusted between 0.1 and 20 μL/min for each fluid.

The internal volume of the reactor (microreactor) 710 is <1 mL and the width of the fluid channels is <1 mm.

The injection system (designated 750 in FIG. 7) may comprise a syringe pump or an HPLC pump. Also, any form of a micropump could be used in the injection system. Furthermore, the injection system may comprise an online membrane filter.

The system 700 further comprises a chemical detection system. The chemical detection system comprises online analysis methods 740 as well as offline analysis methods 780. To summarize, it can be stated that the chemical detection system may comprise a UV/VIS detection. The UV/VIS detection may, for example, be performed using a flow-cell. Similarly, an infrared analysis (IR) can be performed using a flow-cell. Also, circular dichroism (CD) analysis may be performed using a flow-cell. Furthermore, (HT)HPLC analysis can be applied. In addition, the application of capillary electrophoresis (CE) is advantageous. The NMR method is another option for chemical analysis. The chemical detection system may further be able to perform MS (i.e. MALDI-TOF)

analysis. Furthermore, the conductivity of any liquids involved in the chemical reaction can be measured. Also, cyclic voltammetry can be used, just like impedance spectroscopy.

The electronic control and evaluation system 730 (designated also as control unit or control circuitry) can be coupled to a plurality of sensors or actuators. For example, a temperature sensor can be connected to the control unit. For example, a platinum resistor (Pt resistor), an integrated temperature sensor or a fluorescence coating can be used for temperature measurement. Furthermore, the control unit can impact the reaction temperature using an external heat source like a resistor or microwave device. Also, cooling can be applied to the reactor 710 using a cooler. For example, a fan or a Peltier-element can be used.

Furthermore, a laminar flow analyzer can be connected to the control unit. For example, a micro-camera for inhomogeneous phase can be used in order to monitor the laminar flow if there are two separate phases present. In addition, a flow speed sensor can be used in order to monitor or control the flow rates. A pressure sensor can be used to detect clogging and to detect the process pressure.

Overall, the electronic control and evaluation system 730 can be used in order to control the flow, temperature and the operation of the chemical detection systems which are part of the microchemical system 700. As will be described in detail below, the electronic control and evaluation system can be implemented in an advantageous way as a microcontroller-based stand-alone control platform with an interface for the connection of a personal computer (PC).

Another important feature of the inventive system 700 is the integration of the microreactor along with all the other auxiliary systems. Accordingly, the present invention provides a mechanical setup for the integration of a reactor glass/plastic chip, sensor, actuators, electronics interface and fluidic interfaces.

Figure 8:
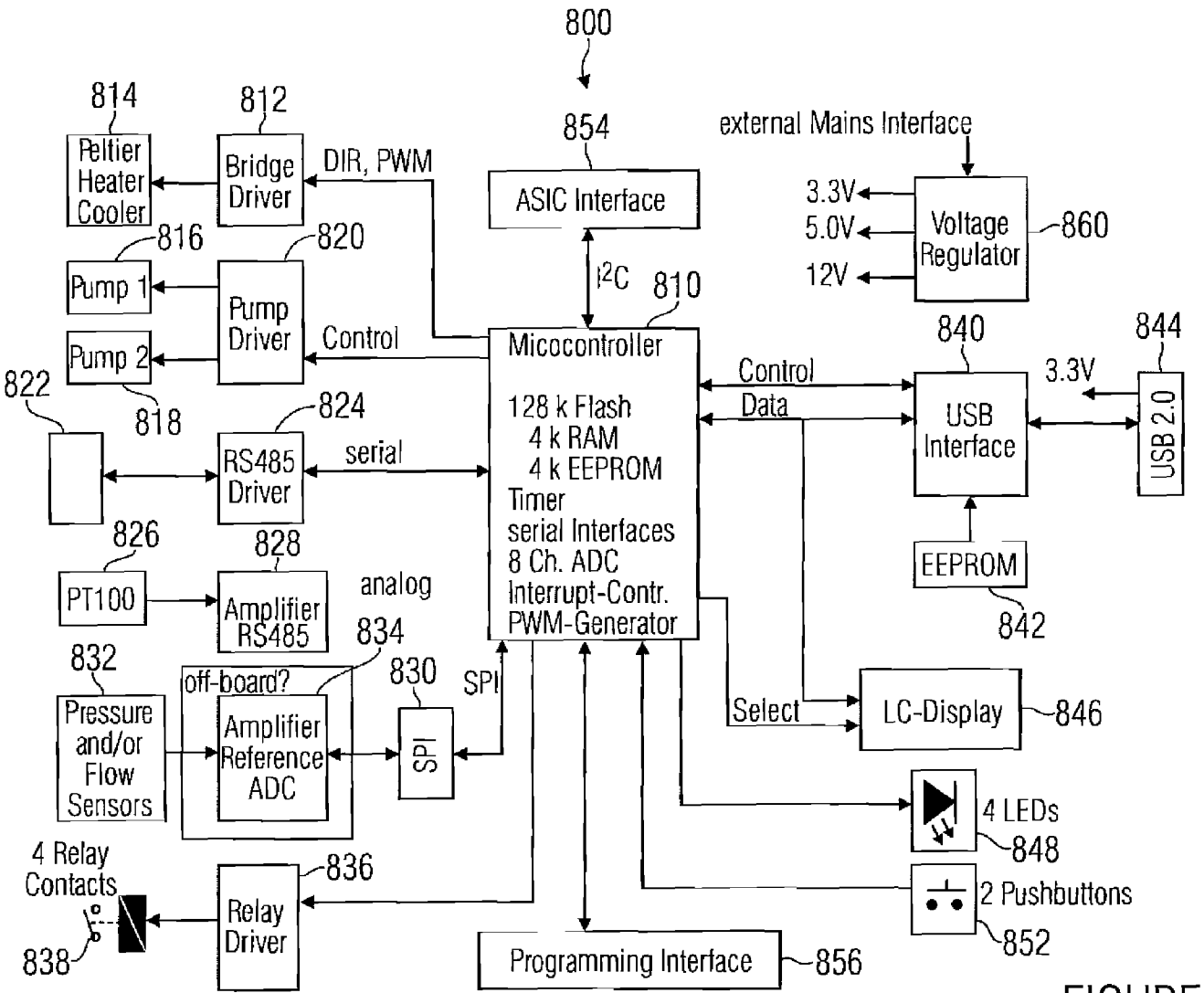
FIG. 8 shows a block schematic of a control circuit for usage in an inventive chip-holder.

FIG. 8 shows a block schematic of a control circuit for usage in an inventive chip-holder. The control circuit is designated in its entirety with 800. The core of the control circuit 800 is formed by a microcontroller 810. The microcontroller 810 may, for example, comprise 128 KB of flash (flash-ROM), 4 KB of RAM and 4 KB of EEPROM. The microcontroller 810 comprises one or more timers, one or more serial interfaces, an 8-channel analog/digital converter, an interrupt controller and a pulse with modulation generator.

The microcontroller 810 may further be coupled over a bridge driver 812 with a Peltier heater/cooler. The bridge driver 812 may receive from the microcontroller signals indicating the direction of the current flow (DIR) and a pulse with modulated signal (PWM) defining the average current through the Peltier heater/cooler and therefore defining the intensity of the heating or cooling.

The microcontroller 810 is further coupled with two pumps 816, 818 over a pump driver 820. Again, a control signal is exchanged between the microcontroller 810 and the pump driver 820. The microcontroller 810 can further establish a serial RS485 connection 822 using an RS485 driver 824. The microcontroller can receive an analog signal from a PT100 temperature sensor 826 over an amplifier 828. The microcontroller 810 further comprises an SPI interface 830 which can be used to connect the microcontroller 810 to pressure and/or flow sensors 832. A coupling means 834, comprising an amplifier, a reference circuit and an analog/digital converter (ADC), may be necessary in order to connect the pressure and/or flow sensors 832 to the SPI interface 830. The coupling means 834 may be located off-board an may be connected with the microcontroller over the SPI interface 830. Over a relay driver 836, the microcontroller 810 can switch relay contacts 838.

Data exchange between the microcontroller 810 and an external personal computer can be performed using a universal serial bus interface 840. The universal serial bus interface is connected to the microcontroller 810 over control lines and data lines and may further be connected with an EEPROM 842. The USB interface 840 can provide a USB 2.0 connection 844.

A liquid crystal display (LC-display) 846 can be connected to the microcontroller 810 using data lines and select lines. Furthermore, four light-emitting diodes (LEDs) 848 may be controlled by the microcontroller 810 to indicate a status of the control circuit 800. Two pushbuttons 852 allow for user input to the control circuitry 800.

The microcontroller 810 further comprises an I2C interface, which can be used as an ASIC interface 854 in order to connect application-specific integrated circuits to the microcontroller 810. The microcontroller 810 further comprises a programming interface which can be used in order to download software from the microcontroller. The programming interface is designated with 856.

The control circuitry 800 is completed by a voltage regulator 860 that receives electrical power from an external mains interface and provides regulated DC voltages of 12 V, 5.0 V and 3.3 V.

To summarize the above, the system architecture of the control circuit 800 can briefly be described as follows: The control circuit 800 comprises one Peltier-element 814 for heating and cooling. Continuous power control is performed in order to stabilize the temperature of the microreactor. Two pumps 816, 818 can be controlled with respect to direction and speed using the pump driver 820. Temperature can be determined over a PT100 temperature sensor 826 in a range between −40° C. and +150° C. with an accuracy of 1° C. Four relay contacts 838 can be used in order to control external devices. External circuitry can also be controlled over the RS485 interface 822. The RS485 interface can also be used for cascading of multiple control circuit boards 810 to allow an inter-board communication. Besides, an ASIC interface 854 based on an I2C interface can provide a connection between the microcontroller 810 and application-specific integrated circuits. Here, a data rate of about 400 kBit/s can be achieved. Communication with a personal computer with a data rate of about 12 Mbit/s (or more) can be achieved over the USB 2.0 interface 840. Additional sensor circuitry can be connected to the microcontroller 810 over the SPI interface 830. For example, sensors for pressure and flow measurement can be connected over the SPI interface 830. Furthermore, software can be downloaded to the microcontroller 810 over the programming interface 856. A local user interface comprises an LC display 846, four light-emitting diodes (LEDs) 848 and two pushbuttons 852.

It has also been shown that an 8-bit microcontroller with 128 kBytes of flash (flash-ROM), 4 kBytes of RAM and 4 kBytes of EEPROM is very well-suited for the control of a microreactor system. The microcontroller 810 of the control circuitry 800 has the following tasks:

- initialization of the (microcontroller) board
- monitoring of power supply
- control of heating and cooling, local regulation of the desired temperature
- control of the pumps 816, 818 (start, stop, speed)
- data acquisition from several sensors
- control of a local user interface (LC display 846, LEDs 848, pushbuttons 852)

communication with an external personal computer (PC) via USB 844 download of local application software via USB 844.

In the following section, details of the injection system will be discussed. The injection system is responsible for controlling the flow of fluid entering the chip. In some embodiments, the injection system may also act on fluid leaving the chip. It should be noted that pumps and corresponding control circuitry are the key components of the injection system.

For a proper operation of the microreactor system 700 it is very important that the flow rates of the fluids in the fluid channels are in agreement with recommended flow rates. This is due to the fact that two-phase flow is stable within a certain region of flow rates. A lower limit of a flow rate is determined mainly by a pulsed working of a syringe pump in combination with a size of the syringe. The following table shows the lower flow rate limits in dependence on the syringe size:

| Syringe size | Lower flow limit |
|---|---|
| 0.1 mL | 0.05 μL/min |
| 1.0 mL | 0.5 μL/min |

The microreactor system 700 has been tested with a CMA/Microdialysis 102 syringe pump. Specifications of the syringe pump CMA/Microdialysis 102 are given in the following table:

| Manufacturer data | |
|---|---|
| Amount of independent driving mechanisms | 2 |
| Amount of syringes per mechanism | 1 |
| Infuse/withdraw | Infuse only |
| Power: | 12 VDC - 600 mA |
| Dimensions | 185 (W) × 135 (D) × 40 (H) mm |
| Weight: | 1 kg |
| Syringes: | Preset to 1 or 2.5 mL syringes with 60 mm graduation length, other syringes possible |
| Flow rate: | 0.1-20 μL/min with 1 mL syringe |
| Flush flow rate: | 20 μl/min |
| Syringes size with RS-232: | Preset to 1 or 2.5 mL syringes with 60 mm graduation length |
| Flow rates with RS-232: | 0.1-20 μL/min |
| Display: | 2-digit LED display showing flow rate or syringe size |
| Motor: | DC motor |
| Self-calculated data | |
| Pusher travel rate: | 6-1200 μm/min |
| Step size (approx.) | 0.65 μm |
| Step rate | 0.15-30 steps/s |

Furthermore, it should be noted that it was found out that at lower flow rates pumping characteristics of the fluid form a problem with the two-phase flows (in the fluid channels of the micro-fluidic chip). It was found that the usage of a syringe pump Harvard Apparatus 11 Pico Plus can result in better pumping characteristics at low flow rates as a spatial resolution of the Harvard Apparatus 11 Pico Plus pump is about 36 times higher than the spatial resolution of the CMA/Microdialysis 102 pump. Accordingly, a pulsating effect will occur at a 36 times lower flow rate using the Harvard Apparatus 11 Pico Plus. Specifications of the Harvard Apparatus 11 Pico Plus syringe pump are listed in the following table:

| Manufacturer data | |
|---|---|
| Amount of independent driving mechanisms | 1 |
| Amount of syringes per mechanism | 2 |
| Infuse/withdraw | Both, switched manually by switch on back side |
| Power: | 12 VDC - 1500 mA |
| Dimensions | 229 (W) × 114 (D) × 114 (H) mm |
| Weight: | 2.3 kg |
| Syringes: | 0.5 μL-10 mL |
| Flow rate: | 0.6 nL-13.9 μL/min with 1 mL syringe |
| Maximum recommended linear force: | 111 N (25 lbs); 66 bar in 1 mL syringe |
| Drive motor: | 1.8 step angle geared 36:1 motor |
| Motor drive control: | ¼ microstepping - Full stepping |
| Motor step per one 3200 at ¼ stepping: | 14,400 steps/rev of the leadscrew |
| Resolution (step size): | 0.0184 μm/step |
| Step rate: | 0.0362-200 step/s |
| Pusher travel rate: | 0.0388-833.3 μm/min |

Alternatively, pumping can be done using an HPLC pump. The advantage is that an HPLC pump (due to the underlying pumping method) provides for a continuous, endless supply of material. Specifications of the Shimadzu HPLC pump LC-10Advp and LC-10Atvp are shown in the following table:

| | LC-10Advp | LC-10Atvp |
|---|---|---|
| Design | Micro double piston pump | Serial double piston pump |
| Mode | Constant flow/constant pressure mode | |
| Flow range | 0.001-9.999 mL/min | |
| Reproducibility | Smaller ±0.3% (RSD <0.1%) | |
| Max. operating pressure | 39.2 Mpa (0.001-5 mL/min) | 19.6 Mpa (<5 mL/min) |
| Time program | Flow rate, pressure, event, LOOP programming, 10 programs max. 320 steps | |
| Plunger rinsing | Automatic, optional rinsing kit | Automatic, optional rinsing pump |
| pH range | 1-13 | |
| Operating temperature | 4~35° C. | |
| Size & weight | 260 W * 420 D *140 H mm, 11 kg | |

In the following section, characteristics of the chemical detection system 740, 780 will be described. A circular dichroism analysis can be performed using a flow cell. In an embodiment of the present invention a commercially available circular dichroism analysis device is used.

Figure 9:
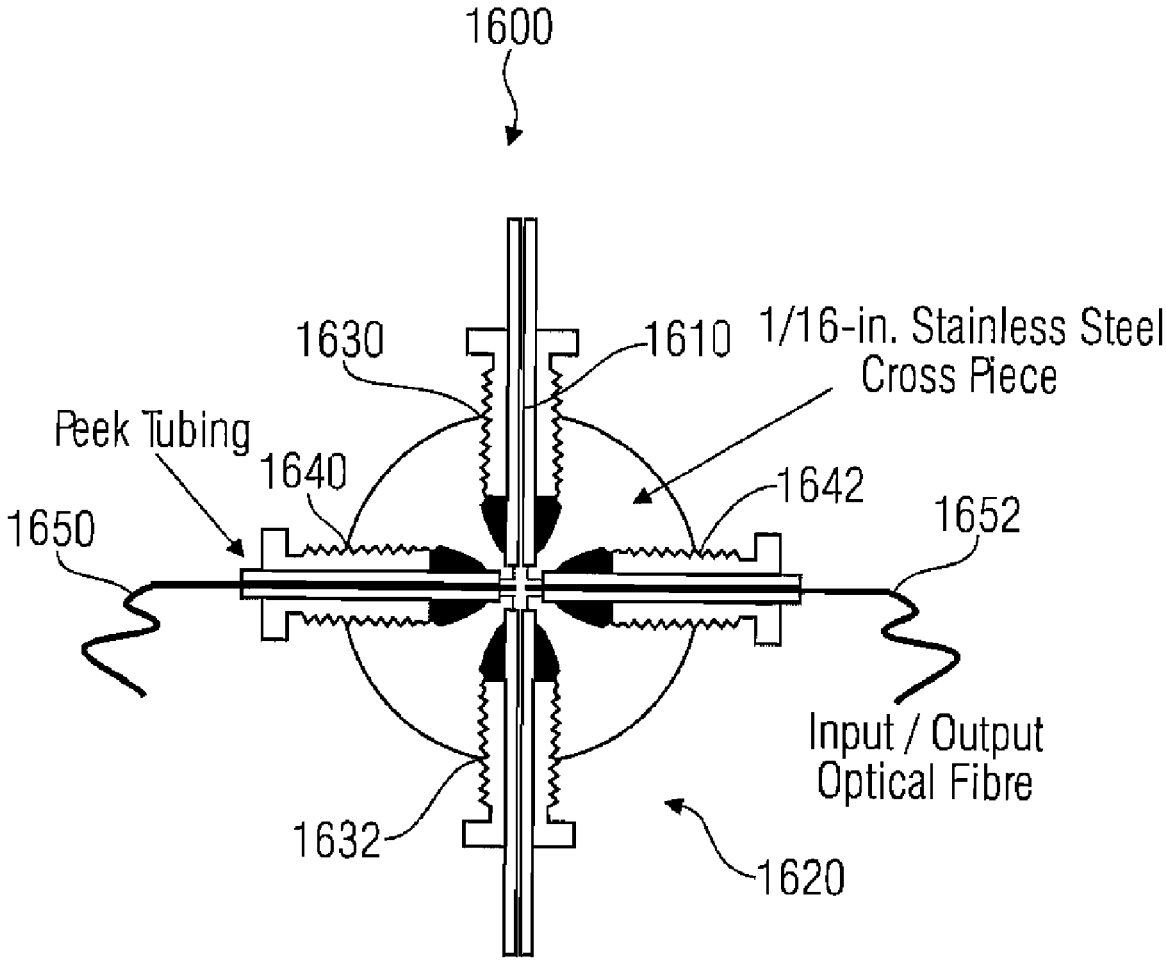
FIG. 9 shows a schematic drawing of a flow cell for chemical detection in a microreactor system.

A chemical analysis using ultraviolet light or visible light (UV/VIS) can be performed using a flow cell. Details of such a flow cell will be described with reference to FIG. 9. FIG. 9 shows a schematic drawing of a flow cell for chemical detection in a microreactor system. The flow cell is designated in its entirety with 1600. Characteristics of the flow cell can be described as follows:

A capillary 1610 is fed through a regular 4-way joint 1620. While two connections 1630, 1632 are used to feed the capillary 1610 through the 4-way joint 1620, further two connections 1640, 1642 are used for a light path being perpendicular to the fluid path. Light is conducted through fiber optics (input/output optical fibers 1650, 1652). The flow cell material may advantageously be fused silica capillary tubing. The length and/or diameter of the light path is dependent on an inner diameter of the tubing, which may typically be in the order of 100 μm.

For further details of the flow cell 1600, reference is made to FIG. 9.

An FTIR chemical analysis can also be performed using a flow cell. For this purpose, the minimum volume may advantageously be chosen to be 2.3 μL. The light path may have a length of 25 μm. For the material used in the FTIR analysis different choices are possible. The material may be determined by the chemical flexibility and the absorbance of infrared (IR) radiation. Accordingly, the detectable window (of wavelength) may be an important criterion. It should be noted here that the region of interest ranges from 400 to about 3000 cm−1.

In order to make the inventive concept more easily understandable, the most important issues will now briefly be summarized. A key concept of the inventive microreactor system is to have an integrated device, in which the glass/plastic reactor is connected with the control and regulation units but can easily be disconnected and replaced by a new glass/plastic module. So, the novel concept of the present inventive microreactor is to have an integrated microreactor system in which the glass or plastic micro-fluidic chip (the microreactor) is connected with control/regulation electronics. This allows chemical reactions to run under controlled conditions when process conditions are regulated using preset parameters or online sensory data in a feedback loop. The micro-fluidic chip and control/regulation electronics can easily be disconnected and a new glass or plastic module can be used with the same electronic unit, or the same glass or plastic module can be used with another electronic unit. Accordingly, the main adjustment and improvement of the new design is the introduction of the sensor and actuator unit inside the chip-holder. Thus, the chip-holder is no longer simply a passive mechanical set-up providing the micro-fluidic chip with fluidic connections to the inlets and outlets. In contrast, integrated sensors (e.g. for temperature, pressure, flow, pH, conductivity, reaction species and reaction yield measurement) and actuators (e.g. for heating, cooling, flow activation, pressurizing, potential biasing and charge delivery) provide the chip-holder with new functions. The novel integration set-up of control/regulation electronics in a chip-holder leads to direct contact with the microchannels without creating a covalent connection. Reaction parameters can be controlled, and exchange of the microreactor chips is easily performed without causing damage to the control unit. This integration leads to a compact, robust and flexible microreactor set-up.

Another chip-on-board (COB) packaging technique with integrated sealing for direct coupling with the microreactor allows placing sensors and actuators in the immediate vicinity of the reactor channels and, when necessary, even in direct contact with the chemicals.

Integration of a barcode on the micro-fluidic chip which can be produced along with the micro-fluidic structure without additional costs allows uniquely identifying each microreactor design. The identification can be done with a standard barcode reader but especially with a barcode reader integrated into the chip-holder providing online access to the chip ID during the time the microreactor is in use.

Furthermore, the integration of an ID-tag into the micro-fluidic chip and a reader unit into the chip-holder allows in addition to the identification of the microreactor type also to document the history of the microreactor (e.g. time in use, type of reaction, chemistry in contact with).

The described architecture of the integrated microreactor system contains a micro-processor board for stand-alone operation with download and upload link to a personal computer. A bus architecture allows a parallelized use of microreactors in batch application for mass production.

Figure 10A:
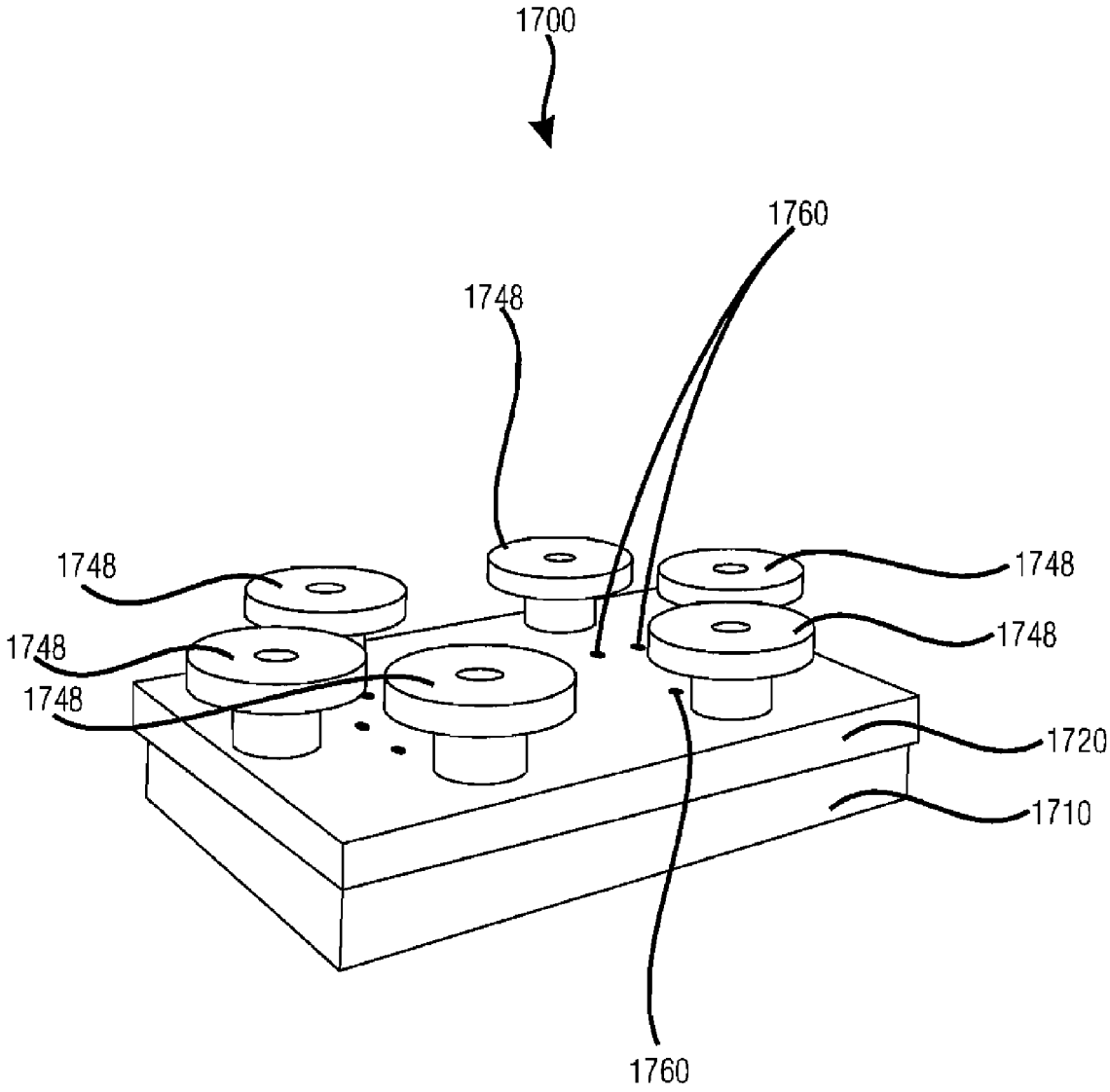
FIGURE 10A PRIOR ART
FIG. 10*a* shows a three-dimensional drawing of a prior-art chip-holder.
Figure 10B:
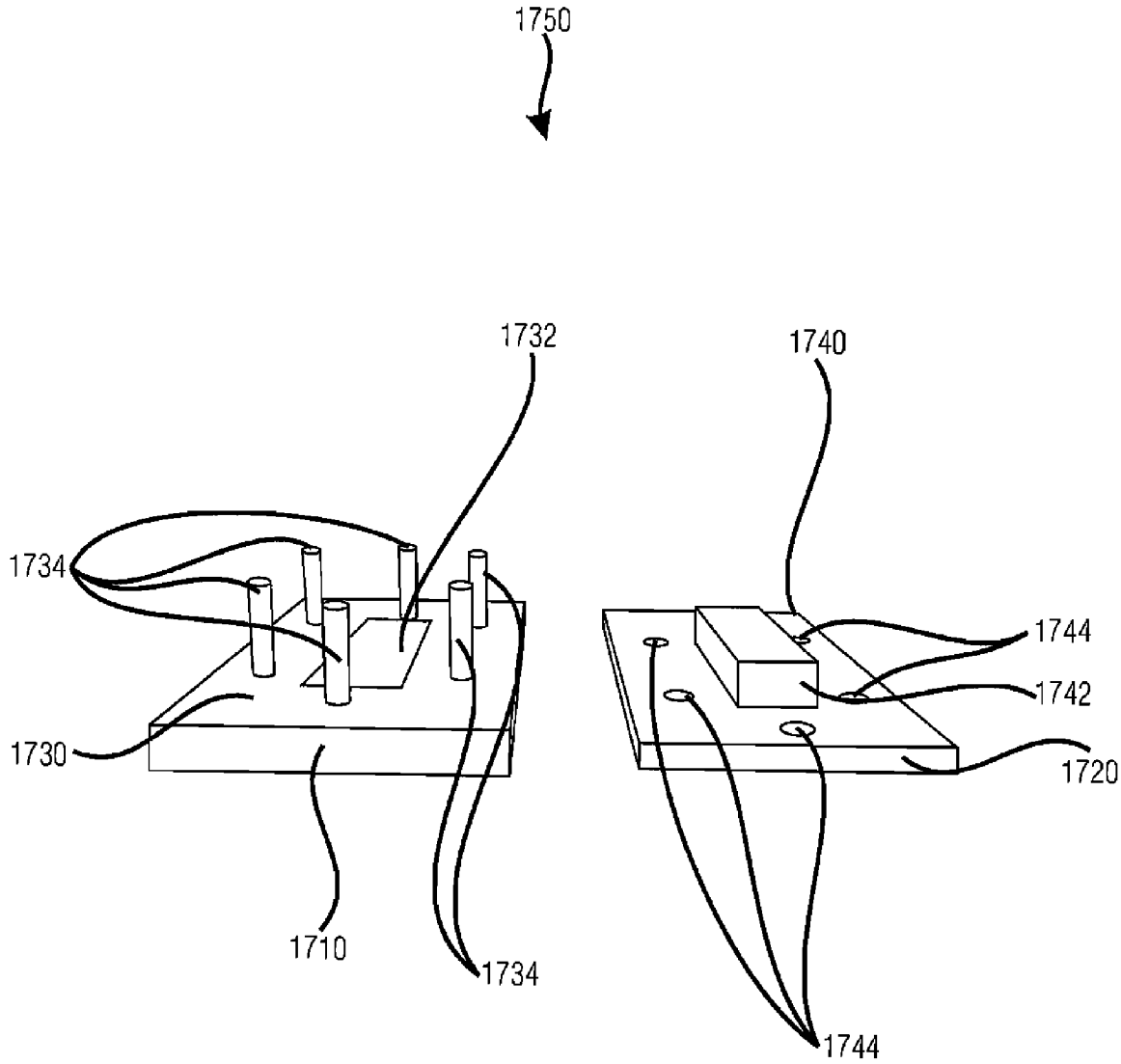
FIGURE 10B PRIOR ART
FIG. 10*b* shows a three-dimensional drawing a the individual components of the prior-art chip-holder of FIG. 10*a*.

The integration of multiple components into the chip-holder is one key achievement of the present invention. Accordingly, the present invention discloses a mechanical set-up for integration of reactors, sensors, actuators and electronics. The integration of the different modules is based upon a modified device, used by Micronit to connect the glass microreactor with the pumping units. The Micronit chip-holder was described with reference to FIGS. 10*a* and 10*b*. The chip-holder has an opening in the bottom. Through this opening, optical inspection of the channel through the transparent glass is possible. For this, a reflected light inverted microscope is necessary. Both brightfield and darkfield can be used to visualize liquids inside the channels. Connection holes of the chip match with the holes in the chip-holder and are used for interaction with the pumping device and analysis units. The main adjustment and improvement to the existing design is the introduction of the sensor and actuator units inside the chip-holder. This leads to direct contact with the microchannels without creating a covalent connection. Reaction parameters can be controlled and exchange of chips is easily performed without causing damage to the control unit. This integration leads to a compact, robust and flexible microreactor set-up. In other words, the main achievement of the present invention is the integration of the control unit in the chip-holder creating a device with direct but non-covalent contact between the reactor and sensors and actuators.

Furthermore, a novel COB packaging technique with integrated sealing was described above. The principle of the novel COB packaging technique with integrated sealing was explained with reference to FIG. 5. As sketched in FIG. 5, based on flip-chip or conducting adhesive technique the sensor and actuator chips are contacted on a printed circuit board (PCB). If the sensor and actuator contact surface has to be on the top side of the chip, through-wafer interconnect technique may be applied. At the bonding interface, an underfiller might be used. Each chip is advantageously surrounded by a flexible polymer (e.g. silicone or viton) ring which seals the printed circuit board tightly at corresponding openings in the cover plate of the microreactor. These openings can be in the vicinity of the reactor channel but also in direct contact with the reactor channel (i.e. in contact with the chemicals).

Overall, it can be said that a novel microreactor set-up has been shown which allows a cost-efficient and flexible application of micro-fluidic chips as a chemical microreactor.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. A chip-holder for holding a micro-fluidic chip comprising an opening, the chip-holder comprising:

a process control device adapted to support control or monitoring of a chemical process in the micro-fluidic chip;

a printed circuit board adapted to provide electrical connection to the process control device; and a fixer for detachably fixing the micro-fluidic chip in the chip-holder such that a surface of the micro-fluidic chip is adjacent to a surface of the printed circuit board;

wherein the process control device is a sensor or an actuator;

wherein the chip-holder is adapted such that the process control device and the micro-fluidic chip are directly and detachably coupled when the micro-fluidic chip is fixed in the chip-holder;

wherein the process control device is adapted such that the process control device is in a direct fluidic contact with the micro-fluidic chip via the opening of the micro-fluidic chip, when the micro-fluidic chip is fixed in the chip-holder;

wherein the process control device is a device chip attached to the printed circuit board;

wherein the chip holder comprises a sealing ring adapted to form a seal which is impermeable to a fluid in the micro-fluidic chip when a circumference of an opening in the surface of the micro-fluidic chip which is adjacent to the surface of the printed circuit board when the fixer fixes the micro-fluidic chip in the chip holder is in contact with the sealing ring, in order to form a fluid chamber bounded by the micro-fluidic chip, the sealing ring and at least one out of the printed circuit board and the process control device chip.

2. The chip-holder of claim 1, further comprising an electronic circuit for processing data from the sensor and for providing an information based on the data from the sensor.

3. The chip-holder of claim 1, further comprising an electronic circuit for providing an electrical signal to the actuator based on an information received from a control interface.

4. The chip-holder of claim 1, further comprising:

an actuator adapted to support control of the chemical process in the micro-fluidic chip;

an electronic circuit adapted to receive a sensor signal from the sensor and to provide an actuator control signal to the actuator, wherein the chip-holder is adapted such that the actuator and the micro-fluidic chip are directly and detachably coupled when the micro-fluidic chip is fixed in the chip-holder; and wherein the electronic circuit is adapted to implement a feedback control circuit for adjusting the actuator control signal in response to the sensor signal.

5. The chip-holder of claim 4, wherein the electronic circuit comprises a microprocessor and an interface circuitry for establishing a connection with an external computer device.

6. The chip-holder of claim 1, wherein the printed circuit board is adapted to be parallel to the micro-fluidic chip when the micro- fluidic chip is fixed in the chip-holder.

7. The chip-holder of claim 1, wherein the device chip comprises a top surface and a bottom surface, wherein an active sensor/actuator area for monitoring or controlling the chemical process is located on the top surface, wherein the bottom surface is attached to the printed circuit board and wherein an electrical connection between the top surface and the bottom surface is implemented using through-wafer interconnects.

8. The chip-holder of claim 7, wherein the device chip is attached to contact pads of the printed circuit board using bumps or conducting adhesive.

9. The chip-holder of claim 1, wherein the device chip comprises a top surface and a bottom surface, wherein an active sensor/actuator area for monitoring or controlling the chemical process is located on the bottom surface, and wherein the bottom surface is attached to the printed circuit board.

10. The chip-holder of claim 9, wherein the device chip is attached to contact pads of the printed circuit board using bumps or conductive adhesive.

11. The chip-holder of claim 9, wherein the device chip is adapted such that a fluid can pass through from the top surface to the bottom surface.

12. The chip-holder of claim 9, further comprising an underfiller layer adapted to fill a volume between the device chip and the printed circuit board.

13. The chip-holder of claim 12, wherein the underfiller layer comprises a recess adapted such that a fluid can contact the active area.

14. The chip-holder of claim 1, wherein the device chip is attached to the printed circuit board using a flip-chip technology.

15. The chip-holder of claim 1, wherein the device chip is an unpackaged chip.

16. The chip-holder of claim 1, wherein the process control device is adapted such that the process control device is in direct fluidic contact with a reactor channel of the micro-fluidic chip, when the micro-fluidic chip is fixed in the chip-holder.

17. The chip-holder of claim 1, wherein the device chip comprises a bottom surface adjacent to the printed circuit board, a top surface opposite to the bottom surface and at least one side surface adjacent to the bottom surface or adjacent to the top surface, wherein the device chip is encircled by a sealing ring contacting the printed circuit board and the at least one side surface of the device chip.

18. The chip-holder of claim 1, wherein the sealing ring comprises a circular or elliptic cross-section.

19. The chip-holder of claim 1, wherein the sealing ring is formed from an elastic polymer.

20. The chip-holder of claim 1, wherein the sealing ring is formed from silicone or viton.

21. The chip-holder of claim 1, further comprising a first fluidic connection to an inlet of the micro-fluidic chip, and a second fluidic connection to an outlet of the micro-fluidic chip.

22. The chip-holder of claim 1, further comprising a barcode reader integrated into the chip-holder and adapted to read a barcode tag of the micro-fluidic chip.

23. The chip-holder of claim 1, further comprising an ID-tag reader integrated into the chip-holder and adapted to read an ID-tag of the micro-fluidic chip.

24. The chip-holder of claim 23, wherein the ID-tag reader is adapted to read out an RF-ID-tag of the micro-fluidic chip.

25. The chip-holder of claim 1, further comprising an opening adapted to allow for an optical inspection of fluid channels of the micro-fluidic chip, when the micro-fluidic chip is fixed in the chip-holder.

26. The chip-holder of claim 1, wherein the chip-holder is adapted such that the micro-fluidic chip is fixed in the chip-holder by a mechanical pressure.

27. The chip-holder of claim 1, wherein the process control device is a temperature sensor, a pressure sensor, a flow sensor, a pH sensor, a conductivity measurement device, a reaction species measurement device, a reaction yield measurement device, a chemical analysis device, a heater, a cooler, a Peltier element, a flow activation device, a pressurizing device, a pump, a potential bias device or a charge delivery device.

* * * * *